US009574556B1

(12) United States Patent
Annen et al.

(10) Patent No.: US 9,574,556 B1
(45) Date of Patent: Feb. 21, 2017

(54) FREE PISTON PUMP AND MINIATURE INTERNAL COMBUSTION ENGINE

(71) Applicant: Aerodyne Research, Inc., Billerica, MA (US)

(72) Inventors: Kurt D. Annen, Rowley, MA (US); Paul L. Kebabian, Acton, MA (US); Michael Agnese, Brookline, MA (US); David B. Stickler, Carlise, MA (US)

(73) Assignee: Aerodyne Research, Inc., Billerica, MA (US)

( * ) Notice: Subject to any disclaimer, the term of this patent is extended or adjusted under 35 U.S.C. 154(b) by 88 days.

(21) Appl. No.: 13/828,687

(22) Filed: Mar. 14, 2013

Related U.S. Application Data

(63) Continuation-in-part of application No. 12/622,654, filed on Nov. 20, 2009, now abandoned.

(60) Provisional application No. 61/116,340, filed on Nov. 20, 2008.

(51) Int. Cl.

| | |
|---|---|
| ***F02B 71/00*** | (2006.01) |
| ***F04B 35/04*** | (2006.01) |
| ***F02B 63/04*** | (2006.01) |
| ***F02B 71/06*** | (2006.01) |

(52) U.S. Cl.
CPC ..... *F04B 35/045* (2013.01); *F02B 63/041* (2013.01); *F02B 71/00* (2013.01); *F02B 71/06* (2013.01); *F04B 2203/04* (2013.01)

(58) Field of Classification Search
CPC F04B 35/043; F04B 39/125; F25B 2309/001; F25B 2500/13; F02B 63/041; F02B 71/00; F02B 71/06
USPC ..... 417/416, 417; 123/46 E
See application file for complete search history.

(56) References Cited

U.S. PATENT DOCUMENTS

| | | | |
|---|---|---|---|
| 3,247,406 | A | 4/1966 | Toesca |
| 3,398,302 | A | 8/1968 | Backstein et al. |
| 3,675,031 | A | 7/1972 | Lavigne |
| 3,766,399 | A | 10/1973 | Demetrescu |
| 4,500,827 | A | 2/1985 | Merritt et al. |
| 4,532,431 | A | 7/1985 | Iliev et al. |
| 4,858,576 | A | 8/1989 | Jeffries et al. |
| 5,002,020 | A | 3/1991 | Kos |
| 6,050,092 | A | 4/2000 | Genstler et al. |

(Continued)

FOREIGN PATENT DOCUMENTS

WO WO2009015596 A1 * 5/2009 ..... F02B 63/04

*Primary Examiner* — Patrick Hamo
(74) *Attorney, Agent, or Firm* — Loginov & Associates, PLLC; William A. Loginov

(57) ABSTRACT

This invention provides a coil and magnet assembly that is operatively interconnected with an oscillating free piston that moves along an axis. A coil mounting disk is operatively connected to a coil assembly. A magnet assembly is mounted on a magnet base. The magnet assembly is coaxial with respect to the coil assembly. The coil assembly and the magnet assembly are in oscillating motion with respect to each other in conjunction with oscillating motion of the free piston. A spring assembly comprising a plurality springs, symmetrically positioned about the axis, extend between the magnet base and the coil mounting disk, so as to move in conjunction with the oscillating motion along the axis. At least some of the springs are conductive and electrically connect the mounting disk to the magnet base. The piston can reside in a casing that is part of either a two-stroke engine or a fluid pump.

21 Claims, 21 Drawing Sheets

(56) References Cited

U.S. PATENT DOCUMENTS

| | | | | |
|---|---|---|---|---|
| 6,094,912 | A | 8/2000 | Williford | |
| 6,349,683 | B1 | 2/2002 | Annen et al. | |
| 6,435,842 | B2 * | 8/2002 | Song | F04B 35/045 267/109 |
| 6,479,964 | B2 | 11/2002 | Woodroffe et al. | |
| 6,532,916 | B2 * | 3/2003 | Kerrebrock | 123/46 E |
| 6,541,875 | B1 | 4/2003 | Berlinger et al. | |
| 7,381,033 | B2 * | 6/2008 | Lee et al. | 417/417 |
| 8,419,385 | B2 * | 4/2013 | Horng | 417/353 |
| 2002/0113573 | A1 | 8/2002 | Woodroffe et al. | |
| 2002/0139323 | A1 | 10/2002 | Kerrebrock | |
| 2005/0212365 | A1 | 9/2005 | Kraus et al. | |
| 2006/0034712 | A1 * | 2/2006 | Park | F04B 35/045 417/417 |
| 2006/0070518 | A1 * | 4/2006 | McGill et al. | 91/359 |
| 2006/0119350 | A1 | 6/2006 | Berchowitz et al. | |
| 2006/0238172 | A1 | 10/2006 | Maehara et al. | |
| 2007/0084271 | A1 | 4/2007 | Boyle et al. | |
| 2007/0158945 | A1 * | 7/2007 | Annen et al. | 290/1 A |
| 2007/0158946 | A1 | 7/2007 | Annen et al. | |
| 2009/0252623 | A1 | 10/2009 | Choi et al. | |

* cited by examiner

FREE PISTON PUMP AND MINIATURE INTERNAL COMBUSTION ENGINE

RELATED APPLICATIONS

The present application is a continuation-in-part of copending U.S. patent application Ser. No. 12/622,654, entitled FREE PISTON PUMP, by Kurt D. Annen, et al., filed on Nov. 20, 2009, which claims the benefit of U.S. Provisional Patent Application Ser. No. 61/116,340, entitled FREE PISTON PUMP, by Kurt D. Annen, et al., filed on Nov. 20, 2008, all of common ownership herewith, and all of which applications are hereby incorporated herein by reference.

FIELD OF THE INVENTION

This invention relates generally to fluid pumping devices and, more particularly, to electrically driven piston pumps.

BACKGROUND OF THE INVENTION

A wide variety of applications require the moving or pumping of fluids. One large category of applications is the moving of fluids, either gaseous or liquid, to transfer thermal energy from one location to another location, such as for cooling or heating. Another category of applications is the moving of fluids as part of a chemical reaction process, such as supplying oxygen or air to the cathode of a fuel cell. Still another category of applications is for supplying a fluid to a device at elevated pressure, such as an air pump for pressurizing vehicle tires.

Many implementations of pumping devices have been developed to address these various applications. The most common and prevalent of these devices use electrical energy as the power source to drive mechanical motion to accomplish the pumping action. One typical example is an impeller fan having multiple blades that are driven in a rotary fashion by an electric motor. Fans are typically capable of moving large fluid quantities at a low increase in the fluid kinetic energy and pressure. Centrifugal blowers are capable of moving large fluid quantities at low to intermediate pressures. Compressors are similar devices that typically have multiple stages of rotating blades and are capable of pumping smaller quantities of fluids at relatively high pressures. Rotary vane pumps use an eccentrically mounted rotor containing sliding vanes to continuously pump fluid at moderate pressures. Gear pumps use multiple rotating gears to continuously pump fluid from the low pressure inlet to an elevated pressure outlet. Reciprocating pumps driven by an electric motor typically convert the rotating action of a shaft to a reciprocating linear motion, particularly employing a crankshaft to drive a piston or diaphragm actuator. Reciprocating pumps typically use check valves or similar devices to prevent reverse flow of the pumped fluid back into the pump chamber once it has been biased in a predetermined, desired flow direction. Linear pumps typically use an electric solenoid drive or other linear electric actuator in a free piston design to create pumping action by moving a piston in a linear motion.

Impeller fans are well-suited for a wide variety of cooling and fluid-movement applications in which the pressure rise requirements are very small, typically 1" $H_2O$ (250 Pa) or less. Fans typically exhibit pumping efficiencies of 50-70%. For applications that require higher pressure rise values, other pumping devices should be considered. To this end, centrifugal blowers can have higher pressure capacity, typically up to 10" $H_2O$ (2500 Pa), though the flow rate at maximum pressure approaches zero and the efficiency is low. Compressors are well-suited for low-flow, high-pressure rise applications. Compressors typically provide pressure rise values from tens of psi to hundreds of psi (0.1-1 MPa and higher). Compressors are generally not employed for cooling, heating, or fluid movement applications.

Rotary vane, gear, and reciprocating pumps are well-suited for intermediate pressure applications that do not require large volumetric flow rates. Rotary vane and gear pumps use sliding surfaces in conjunction with rotating motion. Friction and wear are disadvantages associated with the sliding surfaces. Reciprocating pumps traditionally employ a crankshaft mechanism to convert the rotary motion of the electric drive motor to linear motion of the actuator. Reciprocating pumps typically require lubrication, though use of a diaphragm actuator separates the lubricant from the pumping fluid.

Linear pumps are suitable for both low and intermediate pressure applications. A common limitation on linear pumps with solenoid actuation is low frequency operation which dictates that the pumps be constructed to a large size for a given flow rate. Some reciprocating pump designs incorporate a mechanical return spring to allow operation at increased frequency. Typically, the electrical drive efficiency of linear pumps is low. Current pump technologies have numerous limitations for applications requiring compact size, light weight, low power, and intermediate pressures. Impeller fans exhibit inadequate pressure capabilities. Compressors are heavy and are inappropriate at intermediate pressures. Blowers can provide intermediate pressure at moderate flow rates, though their efficiency is low, and their size and weight are frequently greater than that which is desired for compact applications. Rotary vane pumps and gear pumps exhibit wear issues associated with the sliding parts and a size and weight that may be excessive for the desired application. Reciprocating pumps employ a crank mechanism that experiences wear and generally requires lubrication. In the case of piston pumps, the lubricant also has the potential for contaminating the fluid which is being pumped. Reciprocating pumps usually have a size and weight that exceeds the desired parameters for compact applications.

In addition to the electrically-powered pumping devices discussed above, pumping devices using energy from combustion, either directly as in combustion driven devices, or indirectly such as in steam engine or Stirling engine devices, have been developed. These include free piston pump devices. These devices are typically large and heavy, and not well-suited for low and intermediate pressure applications. These devices are also not suitable for many applications requiring a small size, since they require heat transfer surfaces and cooling flow for heat rejection. They are also generally not suitable for indoor use since they require exhaust ducting and a fuel supply It is, thus, desirable to provide a pump arrangement that can produce a large airflow at intermediate to high pressures in a compact and lightweight assembly. This pump should allow for variable flow and pressure control and relatively quiet operation. The pump arrangement should handle both gasses and liquids, and should be adaptable to a variety of applications including those employing connected conduits and submerged applications. Moreover, the pump should exhibit relatively low wear with few wear parts, and should operate with minimal lubrication or potential for contamination of the driven fluid (gas or liquid). It is further desirable to provide various mechanical improvements to both pumps and other free-piston drive systems such as Miniature Internal Combustion Engines (described further below).

SUMMARY OF THE INVENTION

This invention overcomes the disadvantages of the prior art by providing a fluid pumping device that is highly efficient, compact and lightweight, and has the capability of pumping fluids over a wide range of pressures at high flow rates. This fluid pumping device defines at least three operatively connected components, including a linear motor, a mechanical spring, and a pump head using a piston that is attached to the spring. The moving component of the linear alternator is attached to the moving end of a mechanical spring assembly. Under the drive of a control/power circuit, that delivers an alternating drive current, the moving end of the spring assembly linearly oscillates in both directions about a neutral position. The spring assembly is an energy storage component that allows the pumping device to operate at a higher frequency that could be obtained in absence of the spring assembly. A piston is constructed and arranged to travel reciprocally within the chamber of the pump head, and a rod extends from the piston head and is attached to the spring assembly. The pump head contains one or several chambers, each containing valves, at least one of which opens to discharge the compressed fluid and is otherwise closed, and at least one of which opens to fill the chamber with low pressure fluid and is otherwise closed.

The linear motor in the illustrative embodiment consists of a moving coil, affixed to the moving end of the spring assembly, in electrical connection to an alternating current electrical power supply. The coil reciprocates within the air gap of a permanent magnet, providing the oscillating force to drive the linearly oscillating motion of the spring and piston. Alternatively, the coil can be fixed and a permanent magnet is affixed to the spring to provide the oscillating force to drive the spring and piston.

The mechanical spring assembly in the illustrative embodiment consists of a double helix formed, preferably machined, from one piece of metal stock, preferably titanium or an alloy thereof. However, a triple helix or greater can be used to advantage. One end of the spring is fixed in relation to the pump head and the piston rod is attached to the other end of the spring. During one cycle of the spring movement, the spring is alternately in compression and extension as the free end of the spring is displaced from its neutral point, which is proximally its at-rest position. The spring contains multiple design features that reduce the stress in the spring at the connections to the fixed and moving ends. In an alternate embodiment, the mechanical spring assembly consists of a pair of stacked concentric helical springs, either single or multiple helix in design, are each fixed to a casing at opposing far ends thereof and each bear upon a central plate attached to the shaft at adjacent, confronting ends thereof. One end of the shaft is connected to the piston head and the other end of the shaft is connected to the moving component of the linear motor. This arrangement allows each of the springs to deform mainly in compression in response to the oscillating force exerted by the linear motor that produces an oscillating movement in the central plate about the neutral position of the spring assembly.

The pump head contains a cylinder that is divided into one or more chambers within which the piston, containing one or more discs, linearly reciprocates to provide a pumping action in one direction in one or more chambers, and a suction action in the other direction, in one or more chambers. Each chamber has a fluid connection to an intake valve or valves, and to a discharge valve or valves. During the intake portion of the cycle for each chamber, the intake valve is open and the discharge valve is closed. Correspondingly, during the discharge portion of the cycle for each chamber, the discharge valve is open and the intake valve is closed. The chambers in the pump head may be arranged so that as the piston moves in one direction, one or more pump chambers are in the intake cycle while at the same time one or more pump chambers are in the discharge cycle, with the cycles being reversed when the piston motion is reversed.

In one alternate embodiment, the linear motor may be positioned between the pump head and the spring assembly. In another alternate embodiment, the pump head may be positioned between the linear motor and the spring assembly.

In further embodiments, this invention overcomes disadvantages of the prior art by providing improved spring arrangements and coil electrical lead arrangements for both free piston pumps and miniature internal combustion engines (MICE) using a free piston design. The piston of each type of device is tied by a drive and centering rod to a moving coil that is coaxial in a (coaxial) nested relationship with respect to a magnet assembly. Typically the magnet assembly is mounted stationarily on a magnet base in the pump/MICE housing, and the coil oscillates on a moving coil support disk operatively connected to the rod. A plurality of symmetrically placed springs are fixedly attached between the support disk and the magnet base. In various embodiments, at least some of these springs can comprise (based upon their material and/or a plating/coating) inherently conductive electrical leads between the support disk and magnet base thereby alleviating the use of wire floating leads between the moving coil and the stationary magnet base (and any housing interconnected to the base).

In an illustrative embodiment, a coil and magnet assembly that is operatively interconnected with an oscillating free piston that moves along an axis is provided. This assembly includes a coil mounting disk operatively connected to a coil assembly. A magnet assembly is mounted on a magnet base. The magnet assembly is coaxial with respect to the coil assembly, wherein the coil assembly and the magnet assembly are in oscillating motion with respect to each other in conjunction with oscillating motion of the free piston. A spring assembly is provided, which includes a plurality (e.g. three or four) springs, symmetrically positioned about the axis. These springs each extend between, and are fixedly attached to, the magnet base and the coil mounting disk so as to compress and expand in conjunction with the oscillating motion along the axis. Illustratively, at least some of the springs are conductive, either based upon their inherent material properties or a coating/plating, and electrically connect the mounting disk to the magnet base. The coil can, thus, be interconnected by a lead with a respective first end of each spring of at least some of the springs and a stationary position on a housing can be interconnected by a lead with an opposing, respective second end of each spring. The mounting disk and the magnet base can each be made insulating so as to electrically isolate interconnection with each of the first end and the second end of each spring. Illustratively, each spring of the plurality of springs can be located external of the coil assembly and the magnet assembly, internal to the coil assembly and the magnet assembly, or some springs can be internal and others can be external.

In an illustrative embodiment, the piston is constructed and arranged to move in a cylinder casing having a fuel intake port and exhaust port so as to provide a two-stroke internal combustion engine, and the coil is operatively connected with an electrical charging circuit and an engine control circuit that controls motion of the piston based upon control of the coil. Alternatively, the piston is constructed and arranged to move in a cylinder casing having a fluid intake port and fluid outlet port so as to provide a fluid pump, and the coil is operatively connected with an electrical motor-driving circuit and a motor control circuit that controls motion of the piston based upon control of the coil. In both the engine and pump arrangements the coil can be interconnected by a lead with a respective first end of each spring of at least some of the springs, and a stationary position on a housing is interconnected by a lead with an opposing, respective second end of each spring.

BRIEF DESCRIPTION OF THE DRAWINGS

The invention description below refers to the accompanying drawings, of which.

DETAILED DESCRIPTION

A. General Structure of a Free Piston Pump

Figure 1:
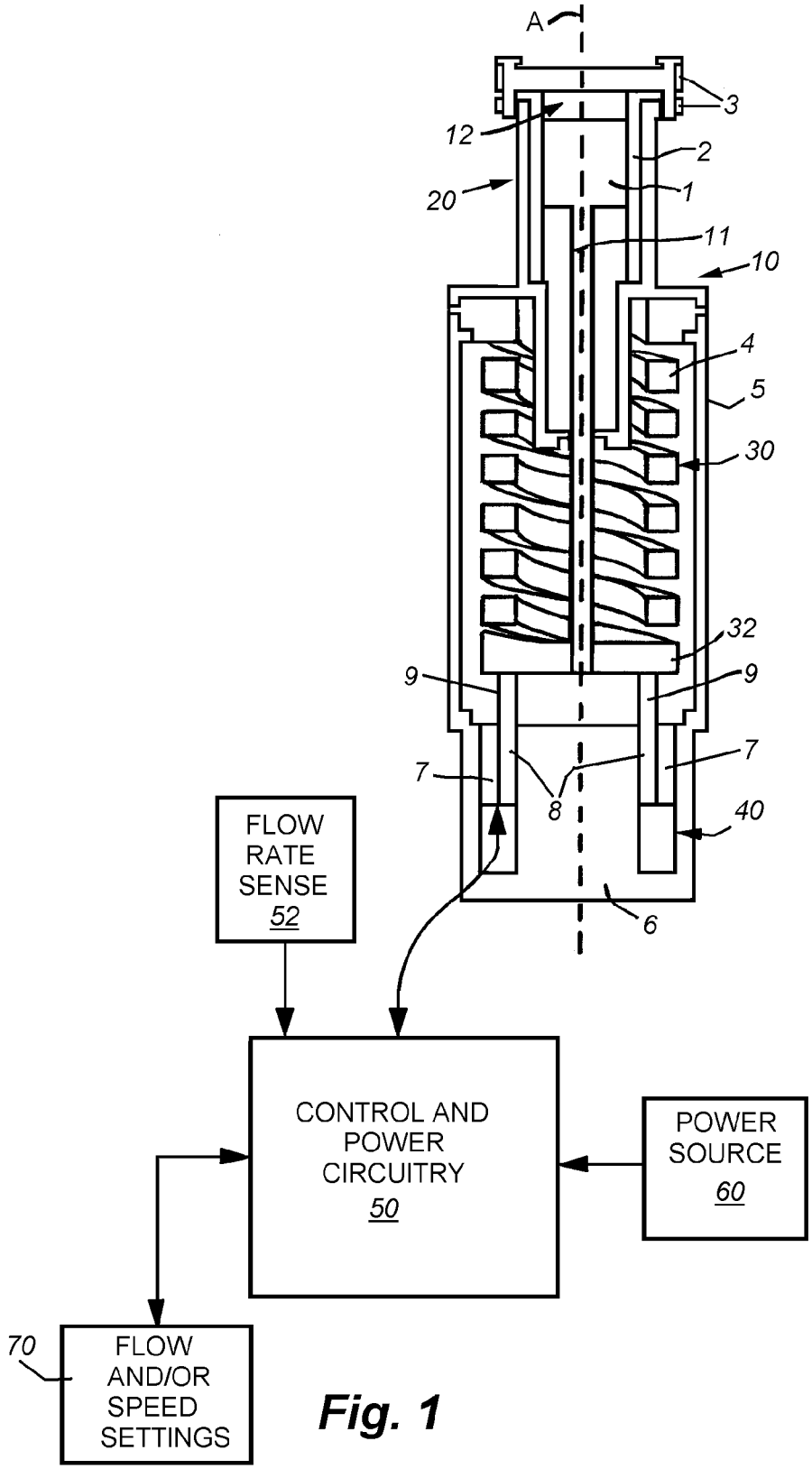
FIG. 1 is a side cross section of on illustrative embodiment of a free piston pump showing the three main components.

An overview of structure of a Free Piston Pump 10 according to illustrative embodiments of this invention is shown in FIG. 1. In general, the illustrative pump includes three operatively connected components, arranged along a common axis A. As illustrated in the view of FIG. 1, the pump head 20 is the top component along axis A, the mechanical spring assembly 30 is middle component, and the linear alternator (also termed a "motor" herein) 40 is the bottom component. The major components of the pump head 20 shown in FIG. 1 are the piston head 1 and rod 11, the cylinder 2, and the pump head casing 3. The major components in the mechanical spring assembly 30 are the multiple helix spring 4 and the spring casing 5. The major components in the linear motor 40 are the magnet poles 6, permanent magnet 7, motor coil 8, and coil standoff 9. In the illustrative embodiment, the piston rod 11 is attached to the free end of the spring 4. The coil standoff 9 is attached to the lower free end 32 of the spring 4 and the motor coil 8 is attached to the coil standoff 9. The pump head casing 3 is aligned with and attached to the spring casing 5, and the motor magnet poles 6 are aligned with and attached to the spring casing 5. The fixed end of the spring 4 is in connection with the spring casing 4 and the pump head casing 3.

Alternating current power is provided to the motor coil 8 at the resonant frequency of the spring-coil-piston system which imparts electromotive force to the free end of the spring 4 via the coil standoff 9, which drives the spring-coil-piston system into oscillating motion at a displacement that is determined by the voltage level of the power supplied to the motor coil. The oscillating motion of the piston head 1 within the cylinder 2 produces a pumping action on the fluid passing through the inner chamber volume 12 of the piston head. The driving alternating current is provided by control and power circuitry 50 that receives electrical power from a source 60, such as an external generator or conventional wall outlet. The circuitry 50 can receive inputs from an optional flow sensor 52 (or other appropriate performance monitor) that allows the output of the motor coil 8 and magnet assembly 7 to be varied and/or stabilized. In general, the voltage supplied by the circuitry 50 to the coil 8 controls the degree of piston stroke, thereby allowing the flow rate of the pump to be maintained. Since the voltage is regulated, overstroking of the coil can be avoided by limiting the maximum voltage (amplitude) of the input power. An appropriate limiting clamp can be provided to the circuitry 50 to ensure that overstroking does not occur. The driving frequency (in Hz) of the power input is set generally to the resonant frequency of the pump's spring and mass system. The discharge pressure of the pump is dependent in part upon the back pressure of the pump head's discharge manifold or plenum, which is determined by the external fluid components. A variety of external valves and other fluid components can be employed to set and/or vary the pressure. In general, control circuitry in accordance with various embodiments herein can be implemented using conventional techniques and electronic components. It is noted that the pump 10 and components 20, 20, 40, thereof, according to the various illustrative embodiments can be adapted from the teachings of a miniature internal combustion engine (MICE) as described generally in commonly assigned U.S. Pat. No. 6,349,683, entitled MINIATURE GENERATOR, by Kurt D. Annen, et al., U.S. Pat. No. 7,485,977 entitled POWER GENERATING SYSTEM, by Kurt D. Annen, et al., and U.S. Pat. No. 7,629,699, entitled SYSTEM AND METHOD FOR CONTROLLING A POWER GENERATING SYSTEM, the teachings of each of which are expressly incorporated herein by reference. These documents teach an approach for providing a mechanical spring assembly that is integrated with a linear alternator/motor. In the present embodiment, the alternator coil assembly of the incorporated patent and patent application is adapted to receive a continuous driving current so as to bias the spring assembly in opposing directions and thereby drive the piston. The piston head of the incorporated patent and application is likewise adapted to direct a flow of fluid therethrough, rather than providing a power stroke in response to combustion. The control circuitry described in each of the incorporated documents is modified by or replaced with the circuitry 50 so as to facilitate continuous driving of the motor as described generally above.

B. Illustrative Pump Head Configurations

Figure 2A:
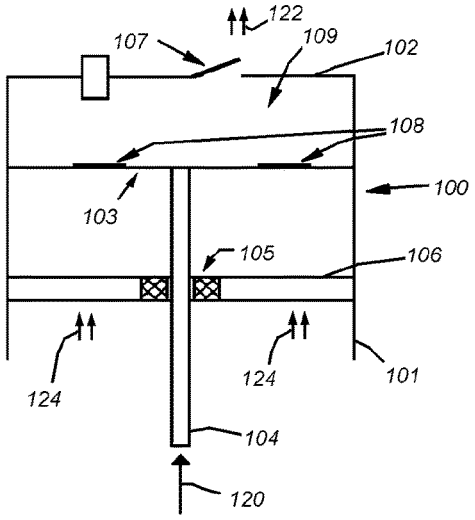
FIG. 2*a* is a somewhat schematic side cross section of a single chamber pump head showing the discharge stroke valve positions according to an embodiment of the invention.
Figure 2B:
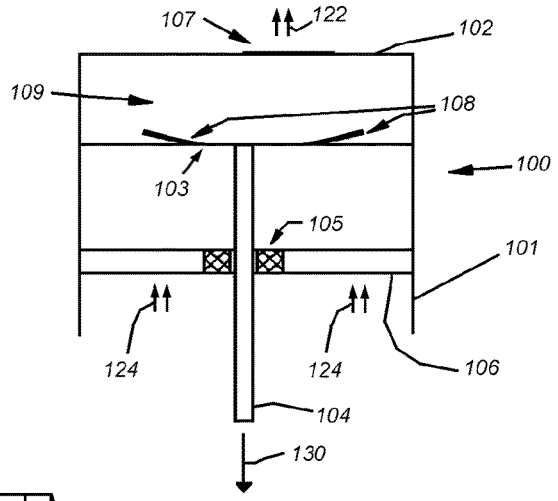
FIG. 2*b* is a somewhat schematic side cross section of the single chamber pump head of FIG. 2*a* showing the intake stroke valve positions.

The operation of the pump head according to various illustrative embodiments is now described in further detail. FIGS. 2*a* and 2*b* show the pumping action produced by a single chamber pump head 100 according to an illustrative embodiment. In a single chamber pump, elevated pressure fluid (air in this example, but other gasses or liquids can be employed in accordance with alternate embodiments) is discharged from the pump chamber volume 109 over half of the pump cycle, and low pressure fluid is drawn into the pump chamber volume 109 over the other half of the pump cycle. FIG. 2*a* shows the discharge stroke (upward arrow 120) portion of a single pump cycle. With the arrangement shown in FIG. 2*a*, on the discharge stroke the piston head 103 rises upward within the cylinder 101 causing a compression of the fluid within the pump chamber volume 109 bounded by the piston head 103, the cylinder 101, and the cylinder top 102. The compressed fluid is discharged (flow arrows 122) from the pump chamber 109 via the discharge valve or valves 107 which are in the open position. While not shown, the outlet fluid can be directed into any acceptable conduit or other receiving volume. Likewise, the fluid inlet (not shown) can be provided at any location along the lower portion of the cylinder 101, or at a location in communication with the lower portion of the cylinder, and can also communicate with a fluid conduit or space that delivers fluid (flow arrows 124) to the inlet.

During the discharge stroke, the inlet valve or valves 108 are closed. In the embodiment of the single chamber pump head 100 shown in FIGS. 2*a* and 2*b*, the movement of the piston rod 104 is guided and restrained from transverse movement by the guide bearing 105 that is fixed in position by a porous and/or perforated guide bearing support disc 106. The guide bearing support disc 106 allows inlet air to flow through the disc so that the fluid pressures on either side of the support disc 106 are approximately equal. FIG. 2*b* shows the intake stroke portion of a single pump cycle. With the arrangement shown in FIG. 2*b*, on the intake stroke the piston head 103 moves downward (arrow 130) within the cylinder 101 causing fluid to be drawn into the pump chamber volume 109 through the inlet valve or valves 108 (flow arrows 132). During the intake stroke the discharge valve or valves 107 are closed to prevent the pressurized fluid from flowing back into the pump chamber volume 109. The discharge valves 107 and inlet valves 108 can be of several designs. An illustrative embodiment provides inlet valves as a check or poppet valve design that is opened or closed by a differential pressure across the valve. Mechanically or electrically actuated valves, such as spool valves or solenoid valves, may also be used in alternate embodiments. The valves are sized appropriately to accommodate the maximum volume of fluid flow expected to be handled by the pump.

Figure 3A:
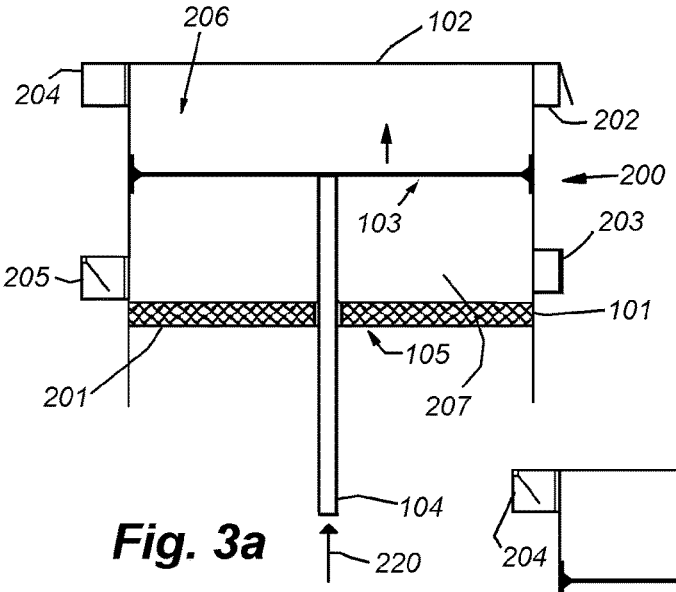
FIG. 3*a* is a somewhat schematic side cross section of a dual chamber pump head showing the upstroke valve positions according to an embodiment of this invention.
Figure 3B:
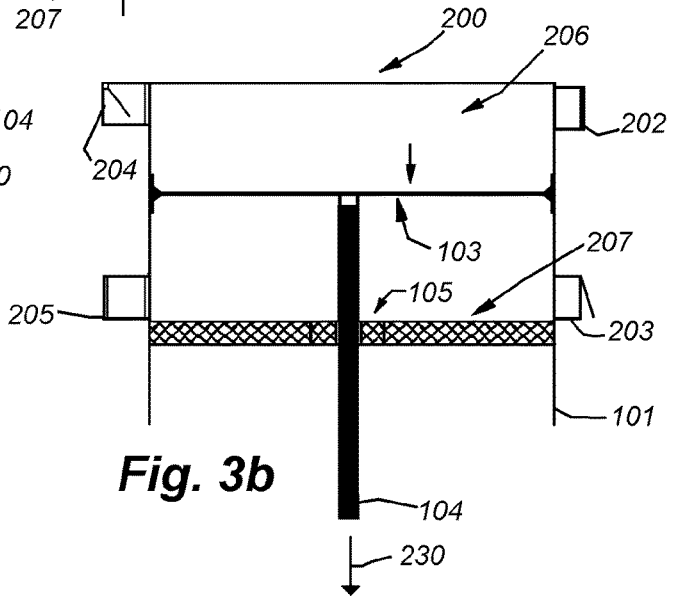
FIG. 3*b* is a somewhat schematic side cross section of the dual chamber pump head of FIG. 3*a* showing the downstroke valve positions.

FIGS. 3*a* and 3*b* show the pumping action produced by a dual chamber pump head 200 according to an illustrative embodiment. This design can be implemented with some elements that are similar to or identical to those of the single chamber pump head 100 described above, and thus, like elements are provided with like reference numbers. Alternatively, different elements can be employed for any and all parts of the pump head 200. The dual chamber design has an advantage of discharging elevated pressure fluid during the entire pump cycle while drawing in low pressure fluid during the entire pump cycle, thereby having a higher fluid pumping rate for a given size piston bore and stroke relative to a single chamber design. The pump head 200 in FIGS. 3*a* and 3*b* shows the discharge valves 202, 203 and inlet valves 204, 205 connected to the cylinder wall 101, in contrast to the design in FIGS. 2*a* and 2*b* in which the inlet and discharge valves were located on the piston head and cylinder top surfaces. Either configuration may be used advantageously in various embodiments.

FIG. 3*a* shows the fluid pumping action during the half of the cycle in which the piston head 103 and rod 104 move upward (arrow 220). On the upward stroke of the piston head 103, the fluid in the upper chamber volume 206 bounded by the upper surface of the piston head 103, the cylinder wall 101, and the cylinder top 102, is discharged from the chamber 206 at elevated pressure through the open discharge valve 202. Also on the upward stroke of the piston head 103, fluid is drawn into the lower chamber volume 207 bounded by the bottom of the piston head 103, the cylinder wall 101, and the guide bearing 105 and a fluid-impervious guide bearing support 201. Fluid enters the lower chamber volume 207 on the upward stroke through the open inlet valve 205 and is retained in the volume 207 by the closed discharge valve 203. The guide bearing support 201 in the dual chamber design in FIG. 2*a* is a fluid-impervious surface, which has impervious connections with the guide bearing 105 and the cylinder wall 101 to prevent fluid in the lower chamber 207 from passing through these surfaces and connections. Furthermore, the guide bearing 105 has a close tolerance fit to the piston rod 104 to minimize fluid leakage through the interface between these components.

FIG. 3*b* shows the fluid pumping action during the half of the cycle in which the piston head 103 and rod 104 move downward. On the downward stroke (arrow 230) of the piston head 103, fluid in the lower chamber volume 207 is discharged from the chamber at elevated pressure through the open discharge valve 203. Also on the downward stroke of the piston head 103, fluid is drawn into the upper chamber volume 206. Fluid enters the upper chamber volume 206 on the downward stroke through the open inlet valve 204 and is retained in the volume 206 by the closed discharge valve 202.

Figure 4A:
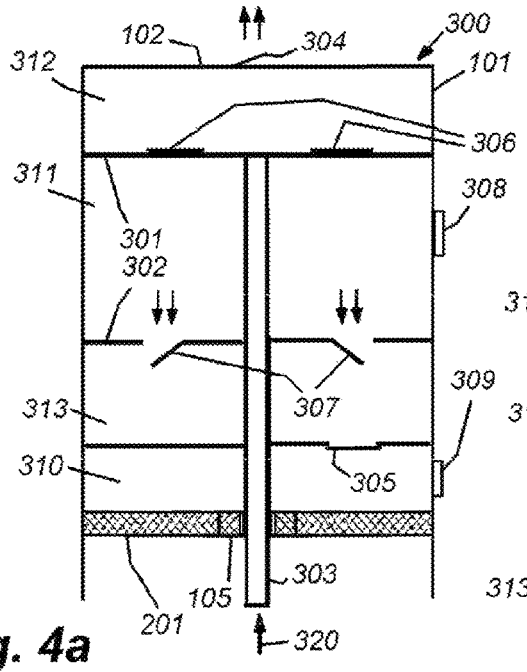
FIG. 4*a* is a somewhat schematic side cross section of a dual chamber pump head with a central inlet chamber showing the upstroke valve positions according to an embodiment of this invention.
Figure 4B:
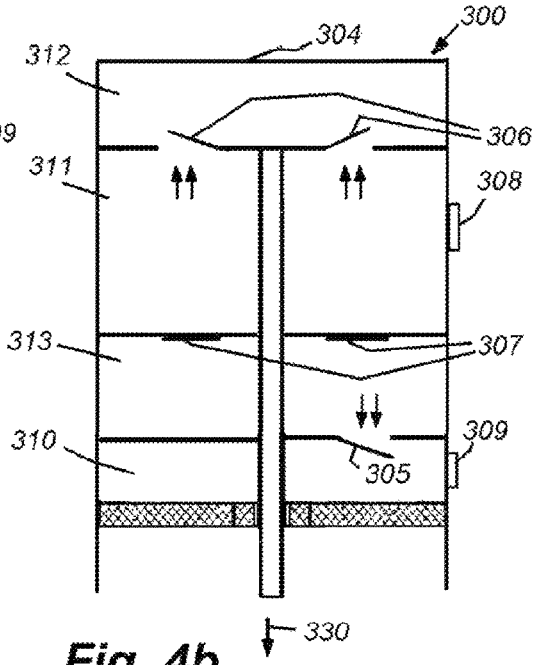
FIG. 4*b* is a somewhat schematic side cross section of the dual chamber pump head of FIG. 4*a* with a central inlet chamber showing the downstroke valve positions.

FIGS. 4*a* and 4*b* show the pumping action produced by a dual chamber pump head 300 with a central inlet chamber according to another illustrative embodiment. In this embodiment, the inlet valves 306, 307 are located on the piston head surface and are assisted in their opening and closing action by the motion of the piston head, allowing more-rapid opening and closure than would be obtained in the absence of the piston head motion. Also in this design, fluid is entering the central inlet chamber volume 311, bounded by the upper piston disc 301, the lower piston disc 302, and the cylinder wall 101, continuously throughout the pumping cycle, and thus minimizing the friction and dissipation losses due to flow stopping and starting.

FIG. 4*a* shows the upstroke (arrow 320) of the piston head surfaces 301, 302 in which elevated pressure fluid is discharged from the upper chamber 312 through the open discharge valve 304. The upper inlet valves 306 are closed during the upstroke. Also during this period, fluid enters the lower chamber 313 through the lower inlet valves 307 while discharge valve 305 is closed. FIG. 4*b* shows the downstroke (arrow 330) of the piston head surfaces 301, 302 during which elevated pressure fluid is discharged from the lower chamber 313 through open discharge valve 305 into the lower outlet plenum 310. The fluid then exits through the outlet port 309. The lower inlet valves 307 are closed during this period. Also during this period, fluid enters the upper chamber 312 through open upper inlet valves 306 while discharge valve 304 is closed. As in the embodiment in FIGS. 3*a* and 3*b*, the guide bearing support 201 in connection with the guide bearing 105 and cylinder wall 101 form an impervious surface with the effect of preventing elevated pressure fluid from leaking out of the lower plenum volume 310 past these surfaces.

Figure 5A:
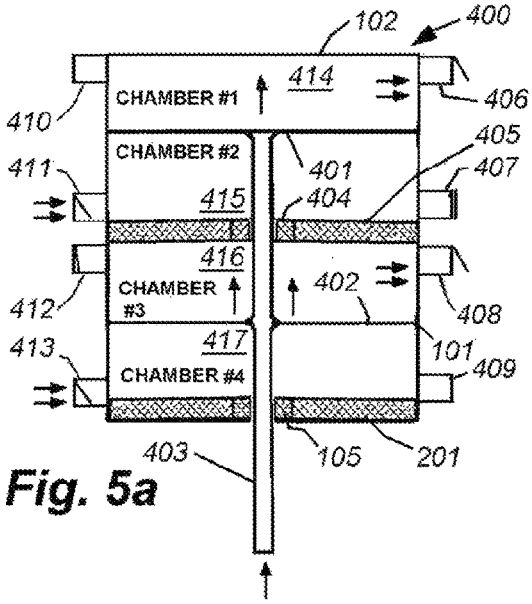
FIG. 5*a* is a somewhat schematic side cross section of a four chamber pump head with dual piston discs showing the upstroke valve positions according to an embodiment of this invention.
Figure 5B:
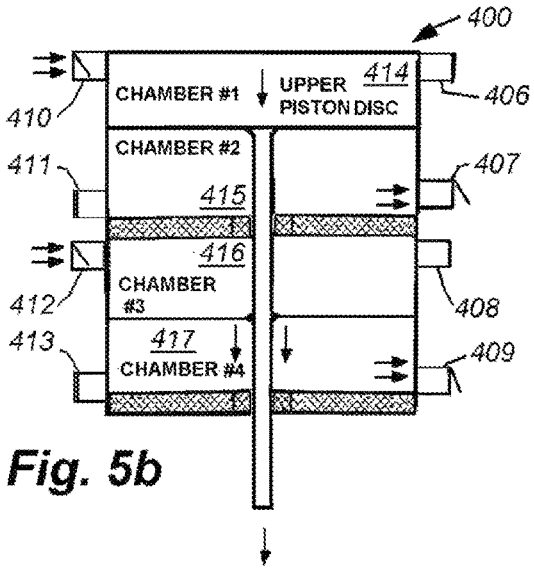
FIG. 5*b* is a somewhat schematic cross section of the four chamber pump head of FIG. 5*a* with dual piston discs showing the downstroke valve positions.

FIGS. 5*a* and 5*b* show the pumping action produced by a four chamber pump head 400 with dual piston discs according to an illustrative embodiment. This four chamber pump head design is representative of additional design variations in which multiple pump chambers and multiple piston discs can be used to advantage to increase the flow rate for given piston bore and stroke dimensions. The four chamber pump head has an intermediate guide bearing 404 and fluid-impervious guide bearing support 405 which forms the lower surface of chamber #2 (415) and upper surface of chamber #3 (416). Guide bearing 105 and guide bearing support 201 also form a fluid-impervious surface for the bottom of chamber #4 (417). FIG. 5*a* shows the upstroke of the piston head surfaces 401, 402 during which the fluid in chamber #1 (414) and chamber #3 (416) is pressurized and discharged out of valves 406 and 408, and also during which fluid is drawn into chamber #2 (415) and chamber #4 (417) through inlet valves 411 and 413. During the upstroke, inlet valves 410 and 412 are closed and discharge valves 407 and 409 are closed. FIG. 5*b* shows the downstroke of the piston head surfaces 401, 402 during which fluid in chamber #2 (415) and chamber #4 (417) is pressurized and discharged out of valves 407 and 409, and also during which fluid is drawn into chamber #1 (414) and chamber #3 (416) through inlet valves 410 and 412.

Manifolds to collect the pressurized discharge fluid for delivery to the pump outlet are omitted in the above-described embodiments for clarity, though they are typically included as a pump head component. Inlet manifolds may be used to advantage, though are not necessary for all pumping applications. For air pumping applications, an inlet manifold may not be needed if air can be drawn from the surrounding environment. Air filters may be used to advantage, typically upstream of the inlet valves. For incompressible fluid and other gaseous pumping applications, an inlet manifold that directs the fluid from the pump inlet to the one or multiple inlet valves will be used in most applications.

C. Alternate Pump Component Arrangements

Figure 6:
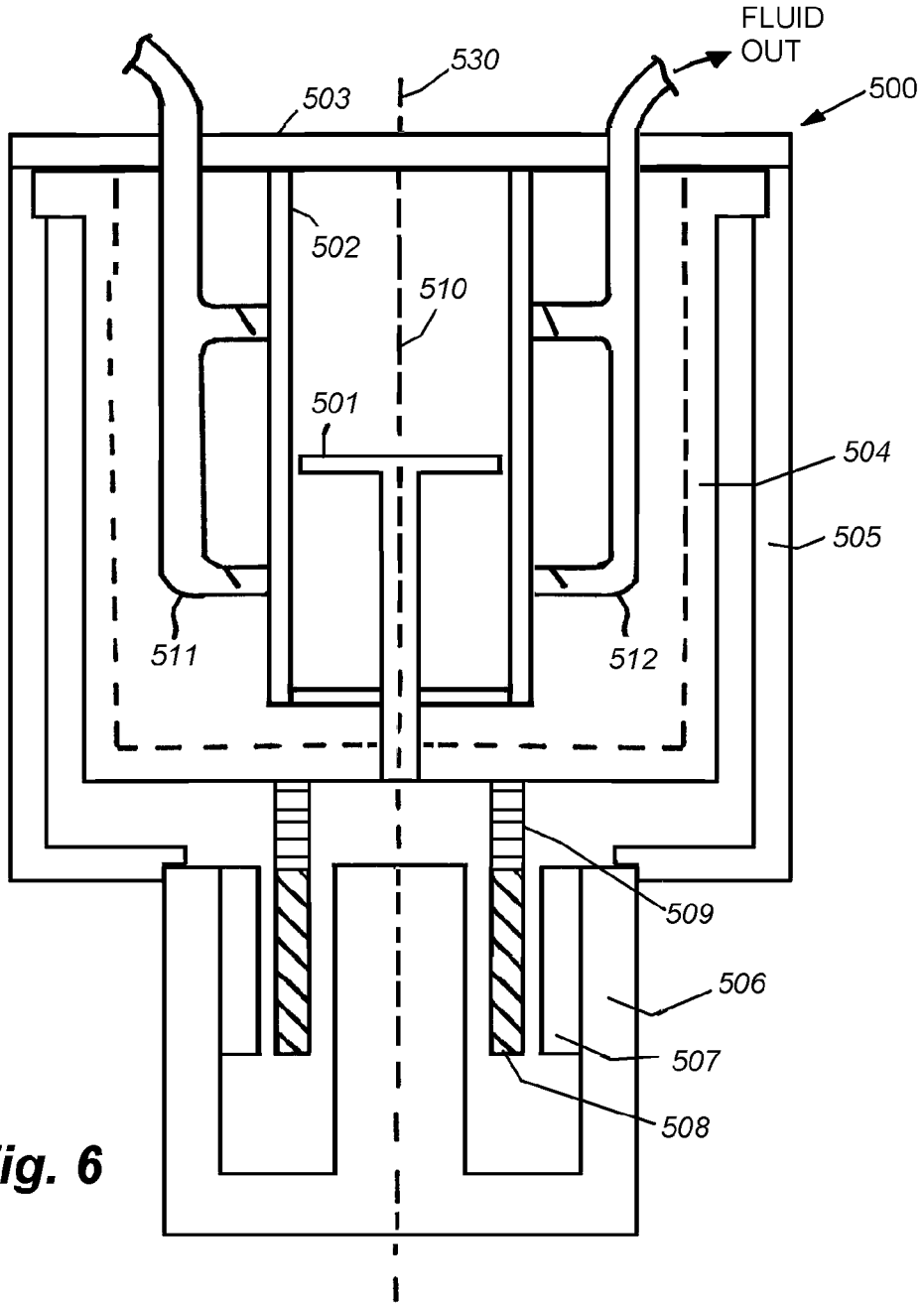
FIG. 6 is a side cross section of a linear motor/spring/depressed pump head arrangement of the free piston pump according to an illustrative embodiment.

Other configurations of the pump head, spring, and linear motor components that are different from the illustrative embodiment shown in FIG. 1 may be used to advantage. An alternate embodiment based on the arrangement in FIG. 1 is to depress the pump head partially or fully within the inner diameter of the spring so as to render these two components coaxial and concentric with respect to the longitudinal axis. FIG. 6 shows an illustrative embodiment of a pump 500. The linear motor components 506, 507, 508, 509 define a similar arrangement to the components 6, 7, 8 and 9 of the single stroke embodiment of FIG. 1. In the present embodiment, the spring 504 and spring casing 505 are constructed with a larger diameter so that the pump head cylinder 502, piston 501, piston rod 510, inlet manifold 511, and discharge manifold 512 fit within the inner diameter of the spring 504. The pump head casing 503 is attached to the spring casing 505, thereby also securing the fixed end of the spring 504. The magnet pole 506 is attached to the bottom of the spring casing 505. The embodiment of FIG. 6 provides a more compact arrangement of the free piston pump components, which may be used advantageously in volume-limited applications. The embodiment shown in FIG. 6 also has a lower height (with respect to longitudinal axis 530) to diameter ratio than the configuration in FIG. 1, which may be used advantageously in certain applications.

Figure 7:
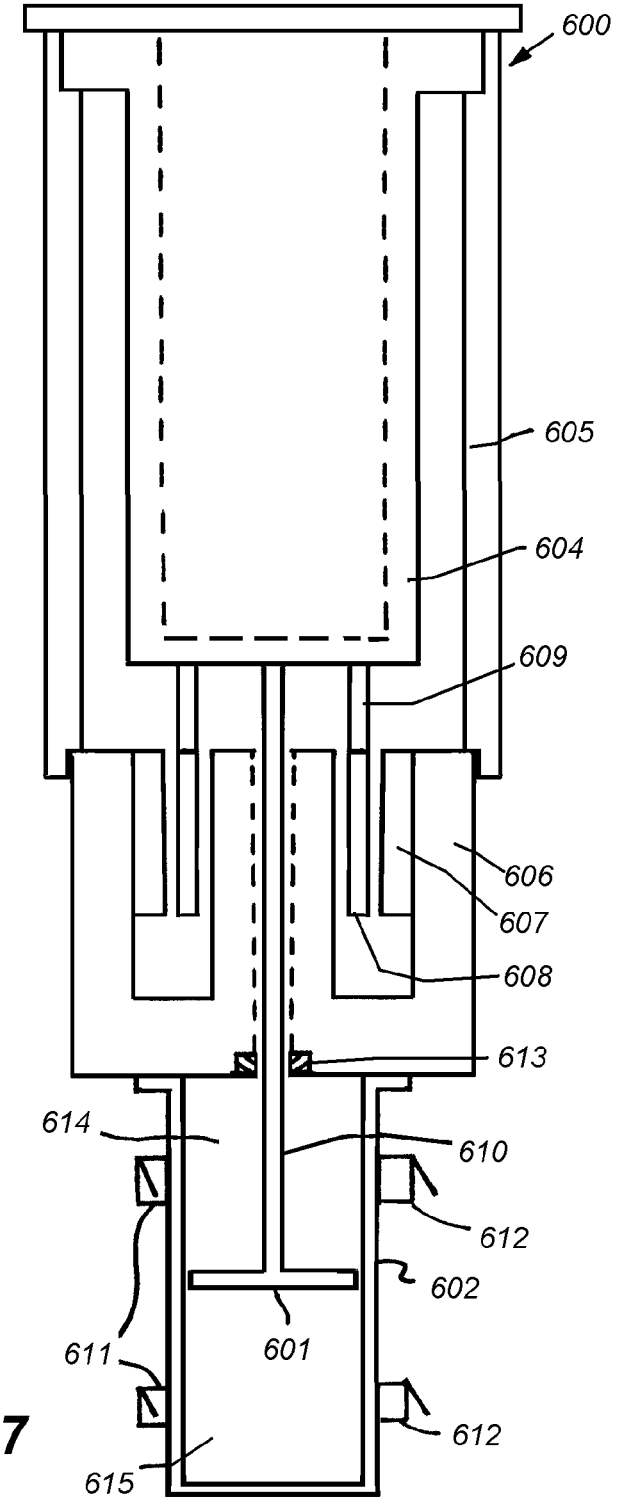
FIG. 7 is a side cross section of a pump/linear motor/spring arrangement of the free piston pump according to another illustrative embodiment.

A configuration that varies the above-described locations of the spring and motor is shown in FIG. 7. In this embodiment, the pump head is located at one end of the pumping device 600, the spring is located at the other end of the pumping device, and the linear motor is in the middle with the piston rod 610 attached to the piston 601 and the spring 604, and passing freely through the center of the linear motor. This configuration can be advantageous in some applications. The spring components 604, 605 and the linear motor components 606, 607, 608, 609 are similar in construction to respective components 4, 5, 6, 7, 8 and 9 of the single-stroke embodiment in FIG. 1 with the addition of guide bearing 613 that operatively connected to the magnet pole 606. The guide bearing 613 together with the magnet pole 606 bottom surface are attached to the pump head cylinder 602 to form a seal for the upper chamber 614. The embodiment in FIG. 7 shows a dual chamber pump head with upper chamber 614 and lower chamber 615, and with inlet valves 611 and discharge valves 612. Other pump head embodiments, including those shown above in FIGS. 2, 4, and 5, may be advantageously employed in this embodiment.

Figure 8:
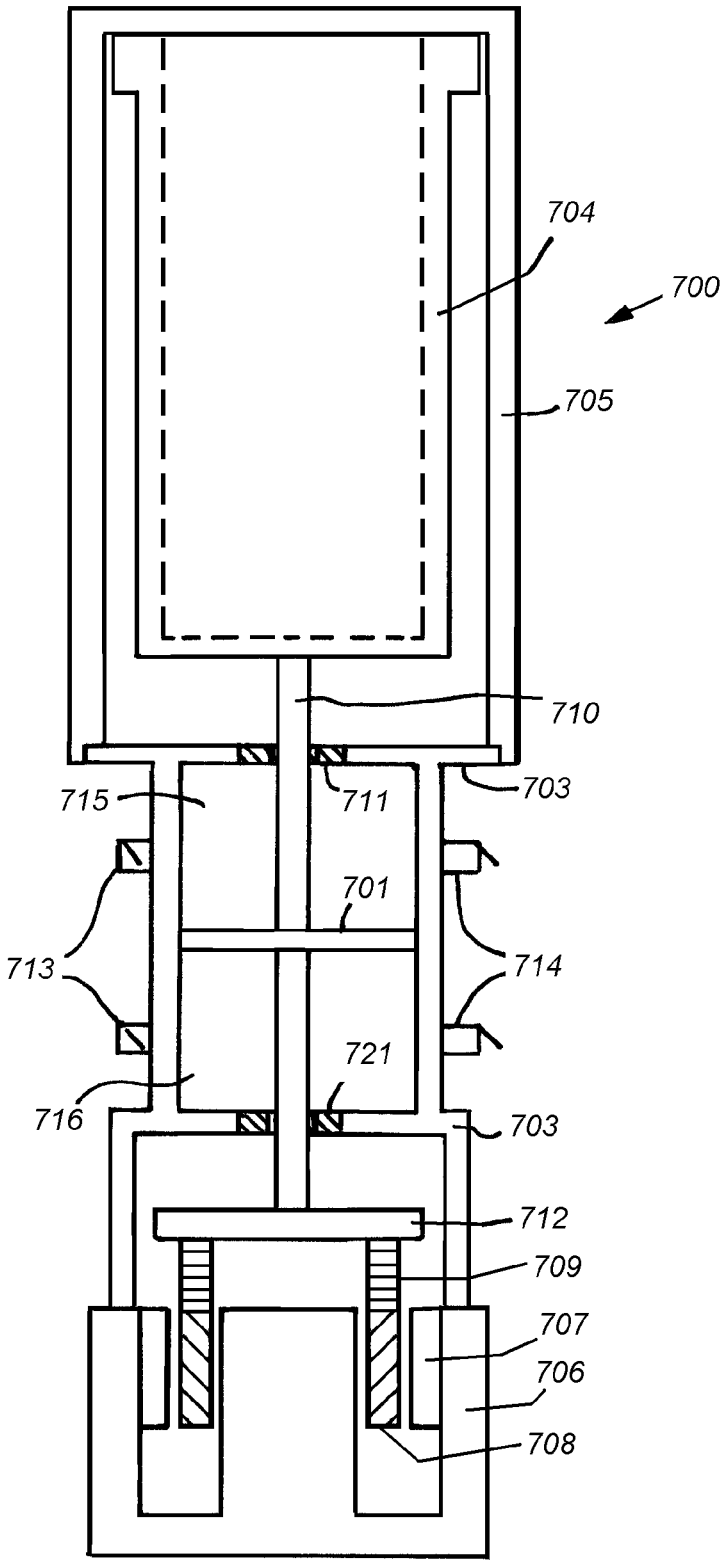
FIG. 8 is a side cross section of a linear motor/pump/spring arrangement of the free piston pump according to another alternate embodiment.

An embodiment that also varies the locations of the spring and pump relative to their respective locations in the embodiment in FIG. 1 may also be employed advantageously. FIG. 8 shows this arrangement in which the spring is at one end of the pumping device 700, the linear motor at the other end of the pumping device, and the pump head is in the middle. The spring components 704, 705 and linear motor components 706, 707, 708, 709 are constructed similarly to the respective components 4, 5, 6, 7, 8 and 9 of the embodiment in FIG. 1, with the coil standoff 709 and coil 708 are attached to a coil support disc 712 that is attached to the end of the piston rod 710. The pump casing 703 is attached to the spring casing at one end and the magnet pole 706 at the other end. A dual chamber pump head configuration is shown in the embodiment in FIG. 8. Guide bearings 711, 721 are supported by the ends of the pump head casing 703 to form the seal for the upper chamber 715 and lower chamber 716. Inlet valves 713 and discharge valves 714 regulate the intake and discharge processes for the pump head chambers. The piston 701 in this configuration is arranged with the rod passing through the piston disc similarly to the piston disc 402 in the four chamber embodiment shown in FIGS. 5*a* and 5*b*.

Figure 9:
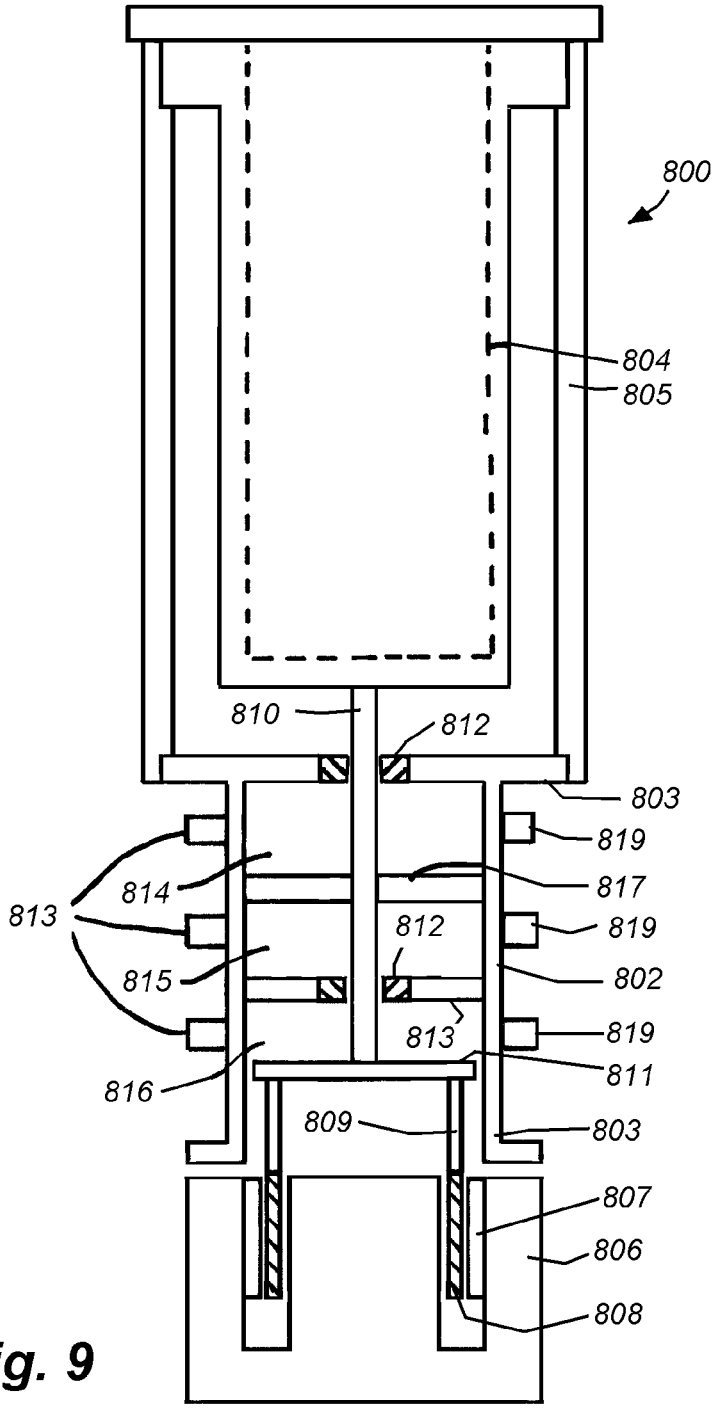
FIG. 9 is a side cross section of an alternate embodiment of the pump/linear motor/spring arrangement of the free piston pump.

A more compact variant of the embodiment in FIG. 8 is shown in FIG. 9 illustrating a three chamber pump head embodiment 800. In this design, the piston head 811 replaces the coil disc support 712 (in FIG. 8) and the cylinder 802 is extended to provide for a third pump chamber 816 that is bounded by piston head 811, the fluid-impervious guide bearing support 813 and guide bearing 812, and the cylinder 802. The piston disc 817 forms the bottom of the upper chamber 814 and the top of the middle chamber 815. Inlet valves 818 and discharge valves 819 regulate the intake and discharge processes for the pump head chambers. Pump components 801, 802, 803, 804, 805, 806, 807, 808, 809 and 810 are constructed and arranged similarly to respective components 1, 2, 3, 4, 5, 6, 7, 8, 9 and 10 of the single stroke embodiment of FIG. 1.

Figure 10:
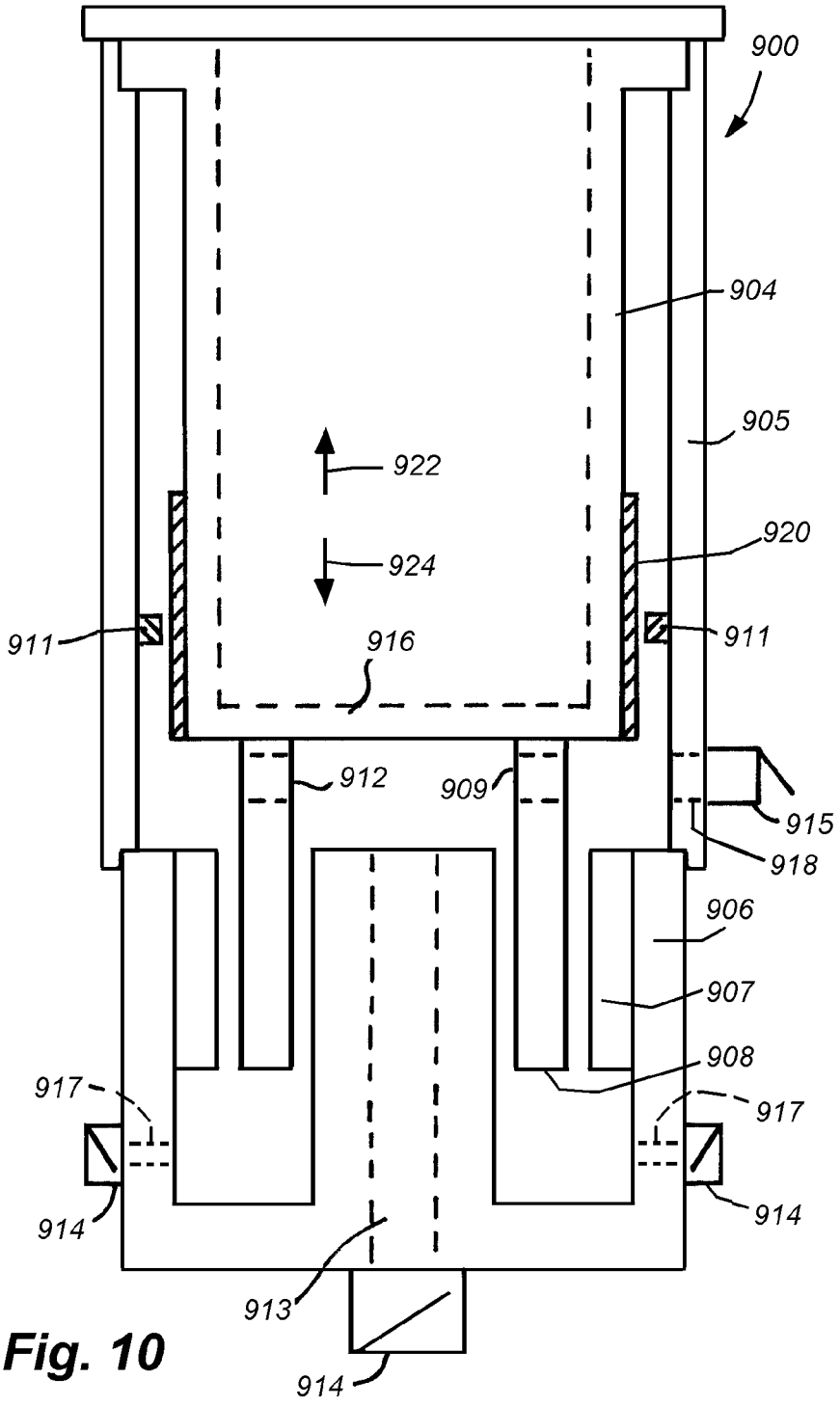
FIG. 10 is a side cross section of a linear motor/integral pump-spring arrangement of the free piston pump for use with gasses according to an illustrative embodiment.

A free piston pump embodiment that can be used advantageously for low and intermediate pressure pumping applications is shown in FIG. 10. In this embodiment, the pump head is integral in the overall pump 900 of the spring and motor components. The pumping action is produced by the linear oscillation of the spring 904, coil standoff 909, and coil 908, driven by AC power as in all previous designs. The pump chamber is formed by the interior volume of the linear motor and the volume defined by the inner surface of the spring casing 905, the spring base 916, the spring seal 911, and the spring sleeve 920. Inlet ports are provided by vent holes 917 located in the magnet pole and a central bore 913 also located in the magnet pole. It is expressly contemplated that inlet ports can be located at a variety of alternate locations The inlet valves 914 regulate the intake flow through these inlet ports. One or more discharge ports 918 are located at an appropriate location within the pump chamber volume, preferably on the spring casing, though other locations may be used to advantage. Discharge valves 915 regulate the flow through the discharge ports. In the single chamber embodiment illustrated in FIG. 10, the intake process occurs during the upstroke (arrow 922) of the spring 904 in which the pump chamber volume as defined above increases, drawing fluid in through the open inlet valves 914 while the discharge valve 915 is closed. The discharge process occurs during the downstroke (arrow 924) of the spring 904 during which the pump chamber volume is decreased and pressurized fluid is discharged through the open discharge valve 915 while the intake valves 914 are closed. Vent ports 912 are located in the standoff to allow fluid to pass from the center region bounded by the spring base 916 the standoff 909 and coil 908, and the center magnet pole 906, to the outer region bounded by the spring base 916, spring sleeve 920, spring casing 905, magnet pole 906, and magnet 907. Components 904, 905, 906, 907, 908 and 909 are otherwise constructed generally similarly to the respective components 4, 5, 6, 7, 8 and 9 of the embodiment of FIG. 1. It should be clear that the size of the spring, pump head and/or coil can be varied as appropriate for the particular pumping application and type of fluid. The housing, piston and other components can be constructed from appropriate materials, such as those described in the above-incorporated patent and published application. For example, the spring can be constructed from a machined titanium alloy multi-helix spring with a rectangular cross section. The housing can be constructed from an appropriate steel alloy. The inner surface of the cylinder with an appropriate low-friction, low-wear coating. In various embodiments, the interface between the piston and the cylinder can include a variety of seals, including piston rings. Alternatively, the interface between the piston and cylinder wall can be a closely conforming ringless fit.

Figure 11:
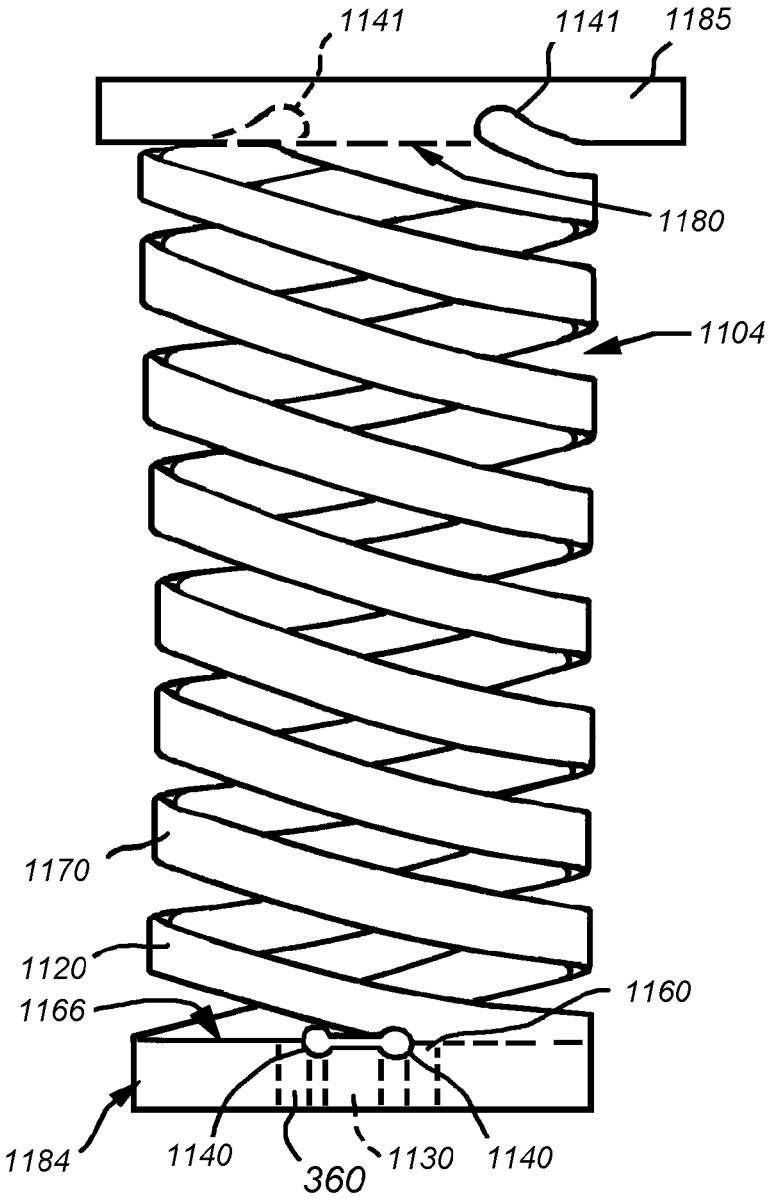
FIGS. 11 and 11*a* are respective side and top views of a machined multi-helix spring with stress reliefs provide at each of opposing ends for use in fluid pumps in accordance with illustrative embodiments.

A variety of additional features may be provided to enhance the performance of the pump of this embodiment, and increase its lifespan. With reference to FIG. 11, a side view of an illustrative, machined double helix spring 1104 for use in various embodiments of this invention (and generally similar to the spring 4 of FIG. 1). In this illustrative embodiment, the spring 1104 includes a unitary top end 1185 that engages the pump housing, and defines a lower shoulder 1180, and the unitary bottom end 1184. The top and bottom ends 1185 and 1184 are joined by a pair of helices 1110, 1120 that define the compressible portion of the spring 1104. Each helix 1110, 1120 includes a rectangular (rather than circular) cross section in this embodiment. Other geometric shapes including circular, ovular and non-regular shapes are expressly contemplated. In this embodiment, the unitary bottom end piece 1184 is arranged with a bored hole 1130 (shown in phantom) that matches a closely-fitting portion of the piston rod (11 in FIG. 1 for example) below a shoulder in the piston rod (11). A threaded end to the piston rod accepts a threaded nut (not shown) to secure the piston rod in the spring bottom end 1184 between the shoulder and the nut. A variety of other attachment mechanisms for securing the bottom end of the spring to the piston rod can be employed in alternate embodiments.

While the spring 1104 of this embodiment is machined from a single piece of a titanium alloy, it is expressly contemplated that the spring may be formed by other methods as one piece or as a plurality of pieces. Forming the spring 1104 as a one-piece, unitary structure has an advantage in that the dimensions and shape can be precisely controlled as compared to plastically deforming a wire or piece of rod to attain the final shape. Moreover, the cross section form of a machined helix can be square, rectangular or some other shape (e.g. regular or irregular polygon, ellipse, etc.) that advantageously resists transverse motion and so better maintains alignment. Moreover, the dimensions of the spring can be controlled so that the mechanical parameters defining the spring can be well-controlled. Those parameters include, but are not limited to, the spring constant (force-per-unit-displacement), number of helices, the oscillating frequency, the mass, the Q (the ratio of stored energy to extracted energy per cycle), stresses, strains, etc.

It has been observed that the points of maximum stress occur where the helices join at the pitch angle to the respective top (fixed) and bottom (free) ends 1185 and 1184 of the spring 1104. In order to reduce the risk of stress or fatigue-related failure of the spring 1104 at these points of stress concentration, each free-end and fixed-end junction includes a milled (or otherwise cut-out using, for example a sinker EDM) rounded "stress-relief" 1140 and 1141, respectively. The size of the stress relief is highly variable. In general, it is centered in the joint approximately between the helix end and the horizontal end piece as shown so that it extends both above and below the joint region. In this manner, as the end of the helix flexes under compression (and extension) with respect to the end piece, the curved joint defined by the stress reliefs 1140 and 1141 are free of a small-radius corner that produces high local stresses that may serve as a location for crack initiation and subsequent propagation to produce a fracture. The diameter of the stress relief 1140 is highly variable. In one embodiment it is between approximately 1 and 4 millimeters in radius.

Figure 11A:
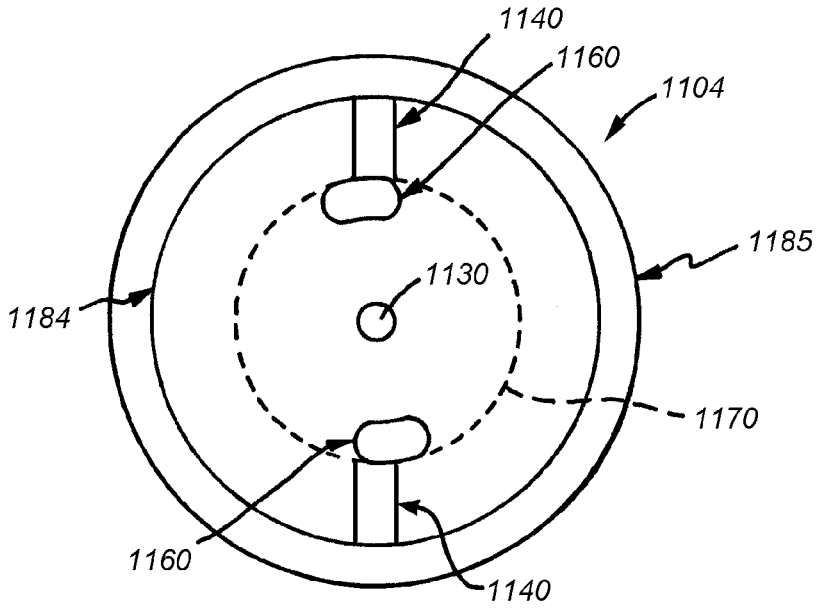

As shown in FIG. 11, the free/bottom end stress reliefs 1140 in this embodiment are defined by rounded cuts at each helix junction. They are aligned with vertical cutouts 1160 (shown in phantom) located inboard on the bottom end 1184, as shown in greater detail in the top view of FIG. 11*a*. These vertical cutouts 1160 further reduce stress concentrations where each stress relief 1140 extends into the planar inner face 1166 (shown partially in phantom) of the bottom 1184 by allowing the relief to extend radially into the cutout (e.g. a fall-off) rather than simply stopping on the bottom face at given radial distance as a corner. The radial-outward edge of each cutout is aligned with the inner edge 1170 (shown in phantom) of the helix structure.

The upper/fixed end stress reliefs 1141 define curving milled slots, as shown, that extend into the fixed end base 1185 at an angle slightly greater than the helix angle with respect to the plane of the inner base surface 1180 (shown partially in phantom). The slots extend radially inward by a width that is equal to or slightly greater than the inner edge (1170) of the helix structure. This helps to ensure that the helix junction is free of concentrated stress with respect to the face 1180.

Figure 12:
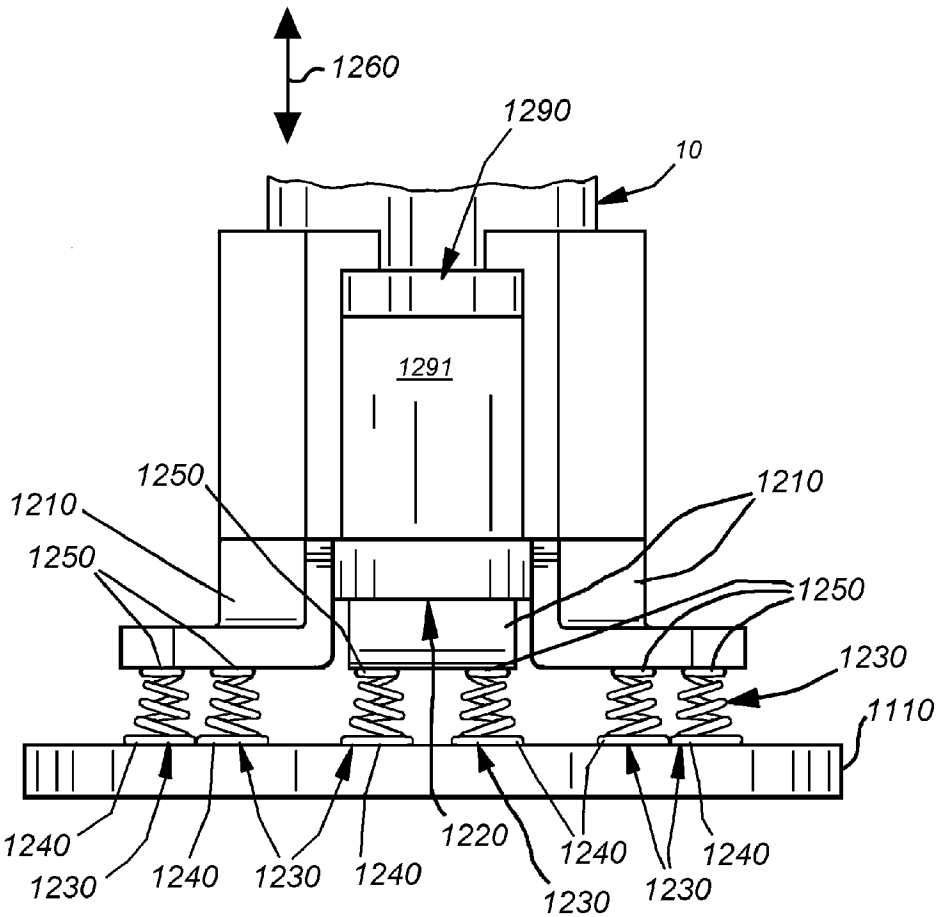
FIG. 12 is a partial side view of a fluid pump according to an illustrative embodiment mounted on a vibration-absorbing base plate that can be part of an external pump housing in accordance with an illustrative embodiment.

The inline piston-spring-alternator coil employed in the pump according to various embodiments can generate significant oscillatory motion within the overall housing generally along the axial direction. As a further feature, FIG. 12 details a vibration-isolation arrangement in which the pump (pump assembly 10 of FIG. 1 in this example) is provided with three equally circumferentially spaced L-shaped base "feet" 1210. The number and placement of feet about the pump housing's circumference is highly variable. In this embodiment the feet 1210 are essentially clamped to the pump lower housing 1291 between a clamp member 1290 and the bottom 1220 of the housing. A variety of arrangements for feet, including those that are unitary parts of the casing are expressly contemplated. In general, the feet 1210 should be securely attached to the pump without any movement between the feet and the pump.

In this embodiment, the feet 1210 each rest on one or two soft springs 1230, which are mounted on the base plate 1110. In this embodiment, the springs 1230 each are conical tapering from a larger-diameter coil 1240 adjacent the base plate 1110 to a smaller diameter coil 1250 adjacent to each respective foot 1210. This design affords good stability and resistance to transverse shear. The springs allow free vibration of the pump along the longitudinal axis (double arrow 1260), in line with the pump head's piston motion, but the springs 1230 are sufficiently strong to prevent the feet 1210 from bottoming on the base plate.

Figure 13:
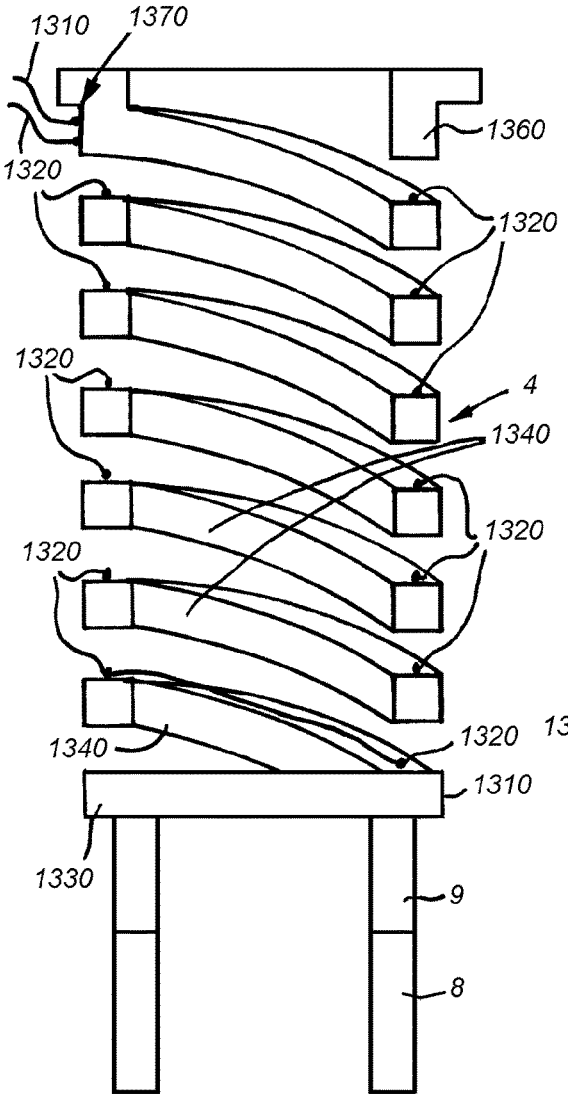
FIGS. 13 and 13*a* are respective front and partial side views of the illustrative placement of coil power leads with respect to helices of the fluid pump spring so as to avoid breakage and/or damage thereto during pump operation.
Figure 13A:
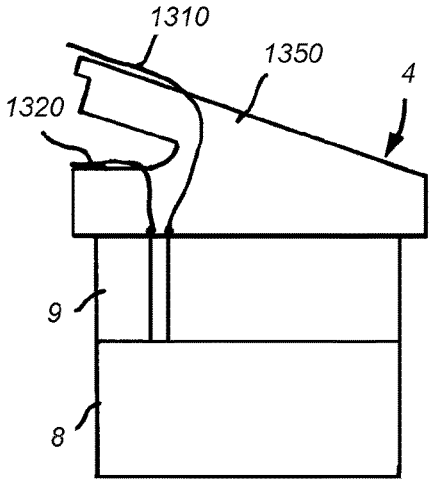

Another feature that can be provided to the pump according to various embodiments herein is the placement of electrical leads that interconnect the moving coil to a power source in the stationary external environment. A concern in the placement of leads is that continuous cyclic movement will eventually cause leads to fail due to breakage and/or fatigue. FIGS. 13 and 13*a* detail a side and partial front view, respectively of a lead attachment arrangement in accordance with an embodiment of this invention. By way of illustration, the lead arrangement of this embodiment is applied to the spring assembly 4 of the pump 10. This arrangement can alternatively be applied to any embodiment contemplated herein. As shown, two power leads 1310 and 1320 extend from the coil 8 and over the surface of the coil standoff 9. In alternate embodiments, the leads can be embedded in the standoff 9. The leads exit the standoff and run along the exterior surface (or alternatively the interior surface) of the spring bottom end 1330. The leads can be any acceptable, durable wire with appropriate flexibility. The leads can be adhered to the bottom end, and other parts of the spring assembly (as will be described) by a durable polymer tape, epoxy adhesive or other attachment mechanism. The leads 1310 and 1320 then separate with each lead 1310, 1320 being adhered to, running along a top surface of a respective helix 1350, 1340 of the spring 4. In alternate embodiments, both leads can run along the same helix. The leads 1310, 1320 extend from the helices 1350, 1340 onto the top end 1360 of the spring 4. The leads are brought together at an exit location 1370 that allows them to be routed out of the pump housing (5 in FIG. 1) through an appropriate orifice or port (not shown). Notably, the leads have been routed from the moving element to the stationary end of the assembly with respect to the housing. Routing the leads along the helices prevents excessive flexure in the leads as the deflection in the leads due to coil movement is absorbed relatively evenly along the entire length of leads in association with the deflection of the spring helices. Note, while leads are attached along the top surface of each helix, it is expressly contemplated that leads can be attached to any side or face of the respective helix. For example, where bottoming out of the spring is a risk (or based on other concerns/reasons), the leads can be applied to the outside and/or inside face—or alternatively to the bottom face of each helix.

Since the overall housing may move with respect to its base springs (1230 in FIG. 12), any wire leads (as well as inlet and outlet conduits interconnected with the pump head) can be "staked" at two locations using clips, ties or similar fasteners (not shown). In this example, one fastener secures the lines at the side of the pump housing casing (on a foot 1210) in this example. Any suitable location on the pump above the springs 1230 can be employed. The other fastener stakes the leads near the base plate 1110 or at another region on an external pump enclosure (not shown). The area of leads between the staking fasteners is long enough and oriented so that it flexes, in essence, as a solid body as the pump oscillates on its springs 1230 with respect to the base plate. Thus, the long solid body-like lead section is less likely to fail over the long term due to fatigue, etc.

Figure 14:
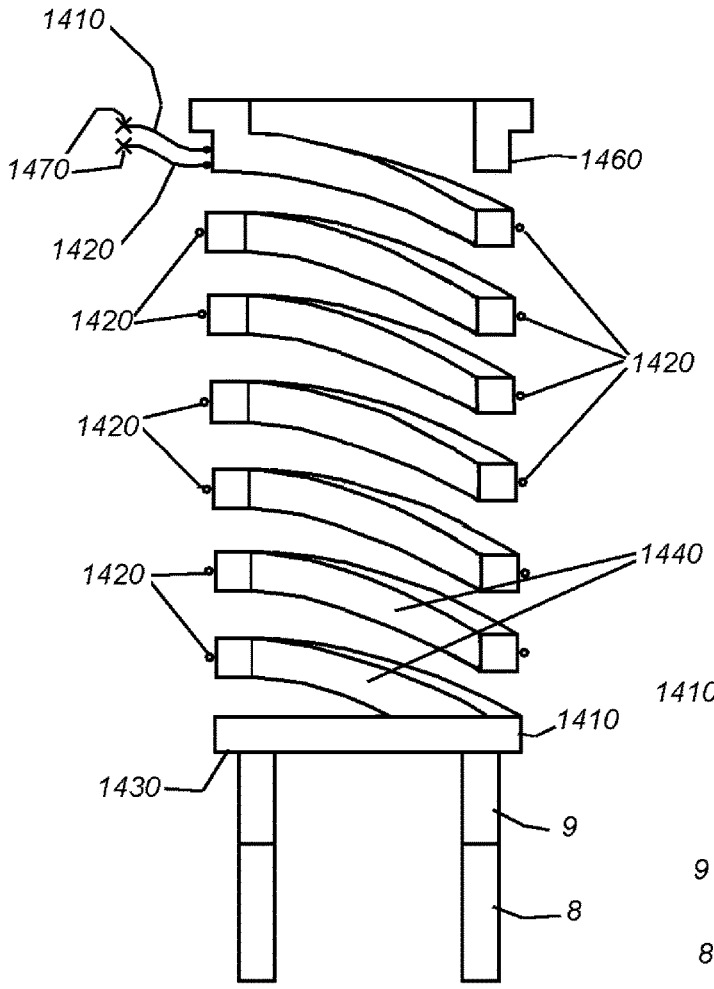
FIGS. 14 and 14*a* are respective front and partial side views of the illustrative placement of coil power leads along the exterior of the helices of the fluid pump or mice spring for interconnecting the pump motor or MICE alternator.
Figure 14A:
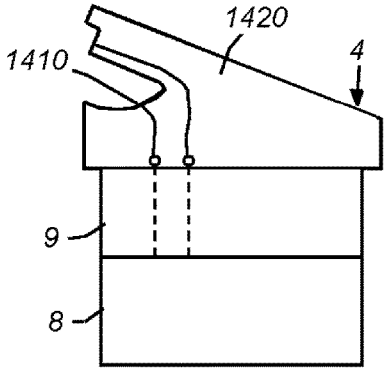
Figure 15:
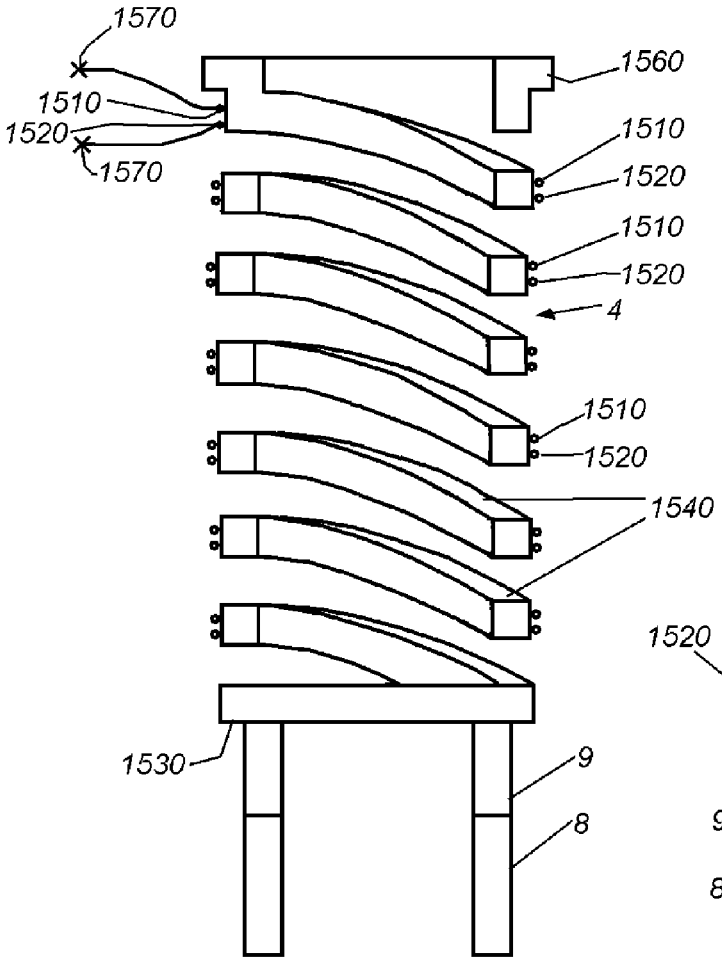
FIGS. 15 and 15*a* are respective front and partial side views of the illustrative placement of coil power leads in which both leads extend along the exterior of the same helix fluid pump or mice spring for interconnecting the pump motor or MICE alternator.
Figure 15A:
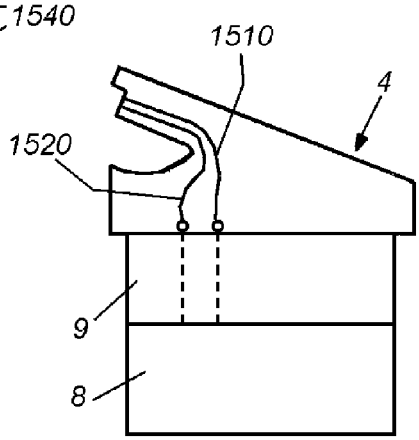

As described above, alternate placements of the electrical leads between the moving coil and outer housing are expressly contemplated, each of which has the goal of providing stationary leads from the moving coil. By way of further non-limiting examples, a plurality of additional arrangements are shown and described variously in the above-incorporated U.S. Pat. Nos. 6,349,683, 7,485,977 and 7,629,699. These placements, as well as that of FIGS. 13 and 13*a*, above are applicable to the spring of a free piston pump as described above, or the spring of a MICE as described in the incorporated Patents. Illustratively, FIGS. 14 and 14*a* illustratively show an alternate arrangement in which leads 1410 and 1420 are embedded along the outer sides of the helical springs 1340 and 1350 of a respective helix. As shown, the two power leads 1410 and 1420 extend from the coil 8 and over the surface of the coil standoff 9. Similarly, and as shown in FIGS. 15 and 15*a*, both leads 1510 and 1520 may be adhered to the same helix 1440 and 1540, respectively. In these embodiments, the leads run from the (fixed) top end 1460 and 1560 of the spring 4 and are brought together at the exit location 1470 and 1570, respectively. This exit location is a typically a fixed position on the stationary housing surrounding the helix. It can, alternatively, be a pair of mounting points to which the spring is fixed, each of which define a contact trace leading to an external circuit (power or charging). More generally, this arrangement allows the leads to be routed out of the pump or MICE housing (5 in FIG. 1).

Figure 16:
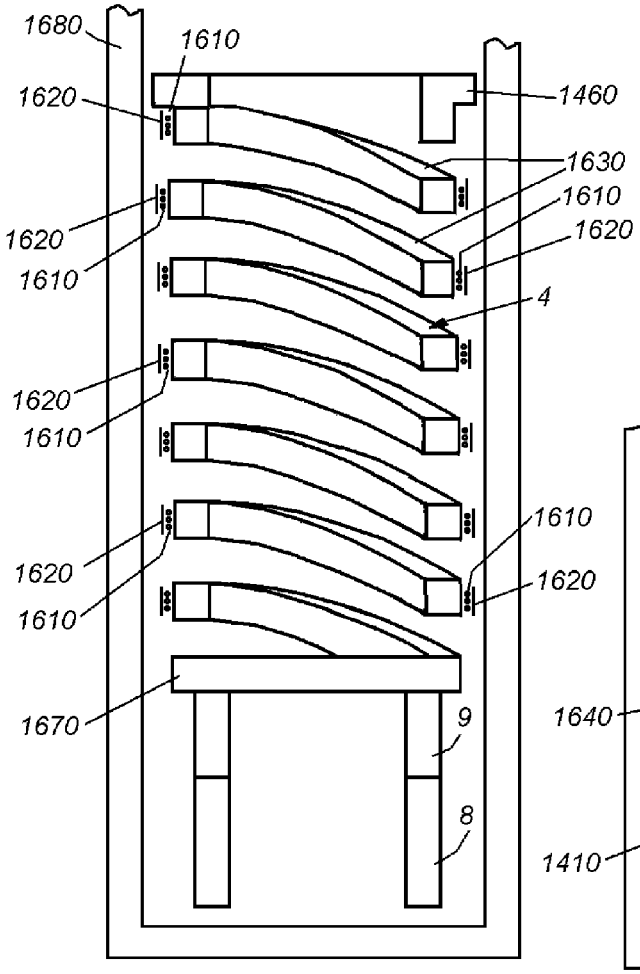
FIGS. 16 and 16*a* are respective front and partial side views of the illustrative placement of coil power leads using a single or two-layer flex circuit attached to the exterior of the helices of the fluid pump or MICE spring for interconnecting the pump motor or MICE alternator.
Figure 16A:
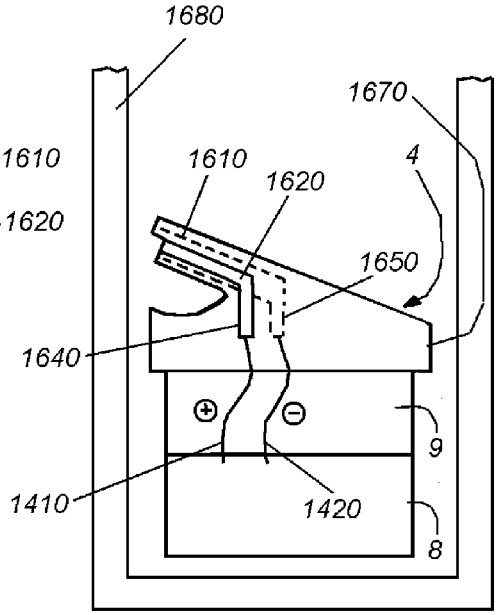

In a further embodiment, and as illustratively shown in FIGS. 16 and 16*a*, leads 1610 (shown dashed) and 1620 (shown solid) are two thin insulated conductive strips in the form of a two-layer sandwich secured along the along the outer sides of at least one helix 1630 of the helical spring 4. Such conductive strips typically include a layer of conductive material (e.g. thin copper and a laminate covering of a durable plastic sheet. The leads 1610, 1620 are attached to the helix (in this example, along the outer face) using appropriate adhesives. The lead material can be custom built or available from a commercial source. As shown, the two power leads 1410 and 1420 extend from the coil 8 and over the surface of the coil standoff 9 and attach (by solder, for example) to respective contact tabs 1640 and 1650 for each conductive layer. These tabs 1640, 1650 are located at the base 1670 of the spring 4. While not shown, the leads or a wire attached to each lead can extend from the fixed spring top end 1460 to an appropriate circuit connection associated with the stationary housing 1680 or an another external structure. In an alternate embodiment, each lead (+/−) can be routed down a different helix of a multi-helix spring, thereby avoiding a sandwiched lead structure.

Figure 17:
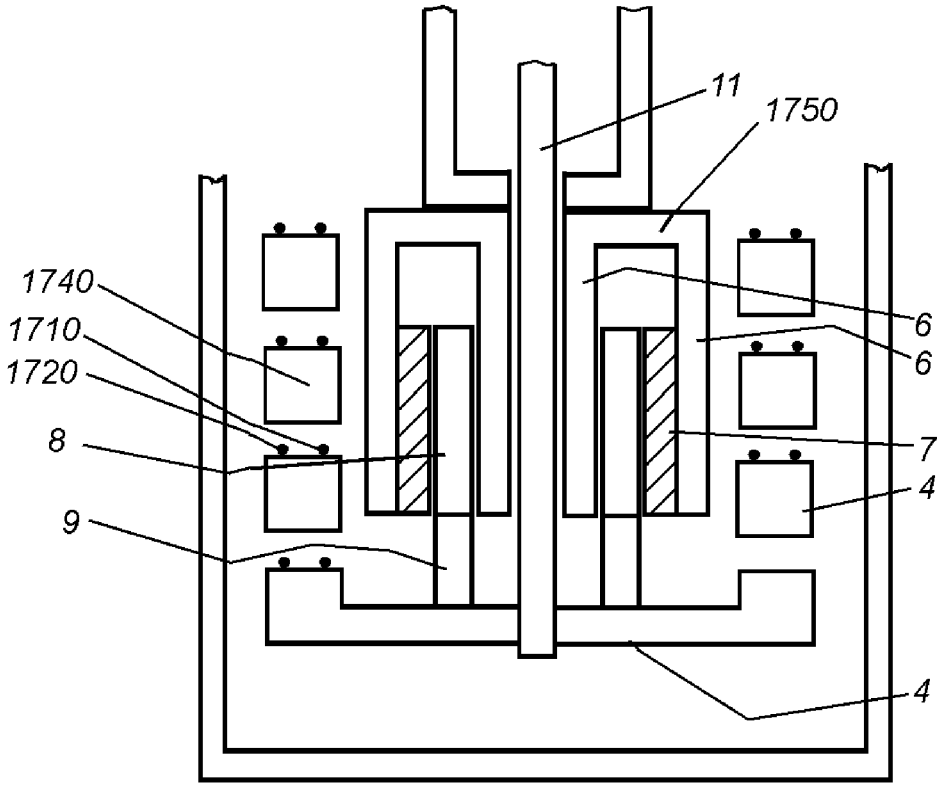
FIG. 17 is a partial front view of an alternate embodiment of an pump motor or MICE alternator within the spring having leads located on the top surface of the helix for interconnecting the coil of the motor or alternator.

In yet a further embodiment, and as illustratively shown in FIG. 17, the spring 4 is constructed and arranged with an enlarged inner diameter, within which the linear alternator/motor 1750 can be located. In this embodiment, the leads 1710 and 1720 reside on the top (or alternatively the bottom) surface of the spring helix 1740. Each of these lead arrangements relies upon one or more leads bridging a gap between a moving element and a stationary element. As such, at least a portion of the leads is subjected to repeated cyclic loading over the life of the unit. To ensure this will not lead to failure of the leads, a labor intensive process of attaching the leads to the spring and also to the housing is typically performed increasing the time and cost of assembling the unit.

In other embodiments, one or more of the leads can simply mounted to the wall of the housing with a flexible bridging connection near the spring base and coil arrangement. Care should be taken to ensure the bridging connection is constructed in a manner that can survive the repeated cyclic motion of the coil.

It is contemplated that certain applications are better served by a spring arrangement and/or coil interconnection arrangement differs from that described generally above. Embodiments of spring arrangements and techniques for electrically interconnecting the moving coil to the pump or MICE outer housing that can provide improved performance and longer life are described below.

D. Illustrative Pump and MICE Spring Arrangements and Wire Interconnections

Figure 18:
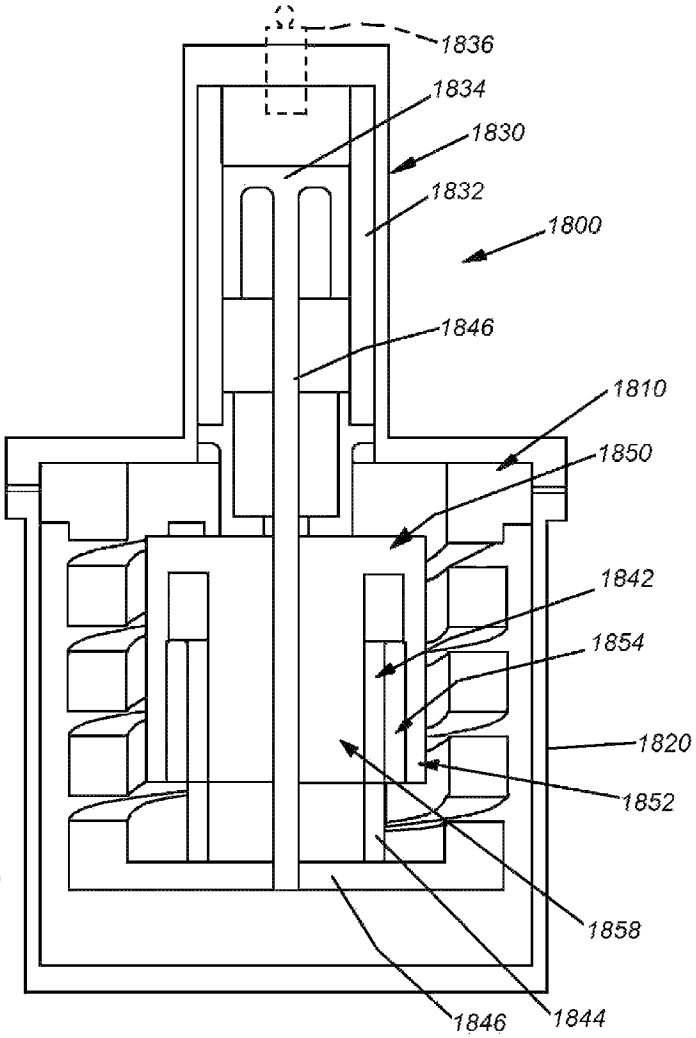
FIG. 18 is a side cross section of a lower length-to-diameter pump/MICE arrangement shown by way of example.

The above-described embodiments of a resonant spring/motor system for providing the actuating motion for a linear free-piston pump provide a plurality of illustrative configurations of the spring, motor, and pump head, each of which defines a spring and motor in a sequential linear configuration as illustrated in FIG. 1. In general, the sequential arrangement of this illustrative spring and motor for the free piston pump provides a length-to-diameter (L/D) aspect ratio of 3 or greater. Similar ratios are provided for a MICE constructed according to the above-incorporated Patents. Some pump and/or MICE applications dictate a more compact arrangement having an L/D aspect ratio (e.g.) on the order of 1. As design for a lower L/D MICE or pump 1800 is shown in FIG. 18. In this exemplary arrangement, the spring 1810 resides in a larger diameter lower housing 1820 that is positioned below a smaller diameter piston housing 1830 that encloses a piston sleeve 1832 and associated piston head 1834. In accordance with the teachings herein, the piston housing can be constructed and arranged to either combust fuel (i.e. with the assistance of a glow plug 1836—shown in phantom), or to pump fluids. The shortened (and widened) lower housing 1820 contains the alternator or motor assembly 1840 within the inner diameter of the spring 1810. Illustratively, the moving coil 1842 is tied to a lower coil standoff 1844 that is fixed to the base 1846 of the spring 1810. The piston rod 1848 is tied to the spring base 1846. Thus in a pump arrangement, the motion of the spring and its carried coil 1842, under drive of the motor, causes the piston head 1834 to reciprocate. Conversely, in a MICE arrangement, the down stroke of the piston head 1834 during combustion causes the spring 1810 and its coil 1842 to move through the stationary magnet assembly 1850, generating energy. The stationary magnet assembly 1850 is attached to the top end of the motor/alternator housing 1820 and is coaxial with the moving coil 1842. The magnet assembly

1850 consists of an outer magnet pole 1852 and a ring magnet 1854 external of the coil 1842 and an inner magnet pole 1858 internal of the coil 1842. This arrangement illustratively employs one multiple-helix spring (1810). Thus, this spring design is typically large and heavy, having less than one full spring coil turn. While the overall arrangement of components makes for an advantageous pump/MICE form factor in many applications, the large spring weight and the low number of spring coil turns are disadvantageous.

Figure 19:
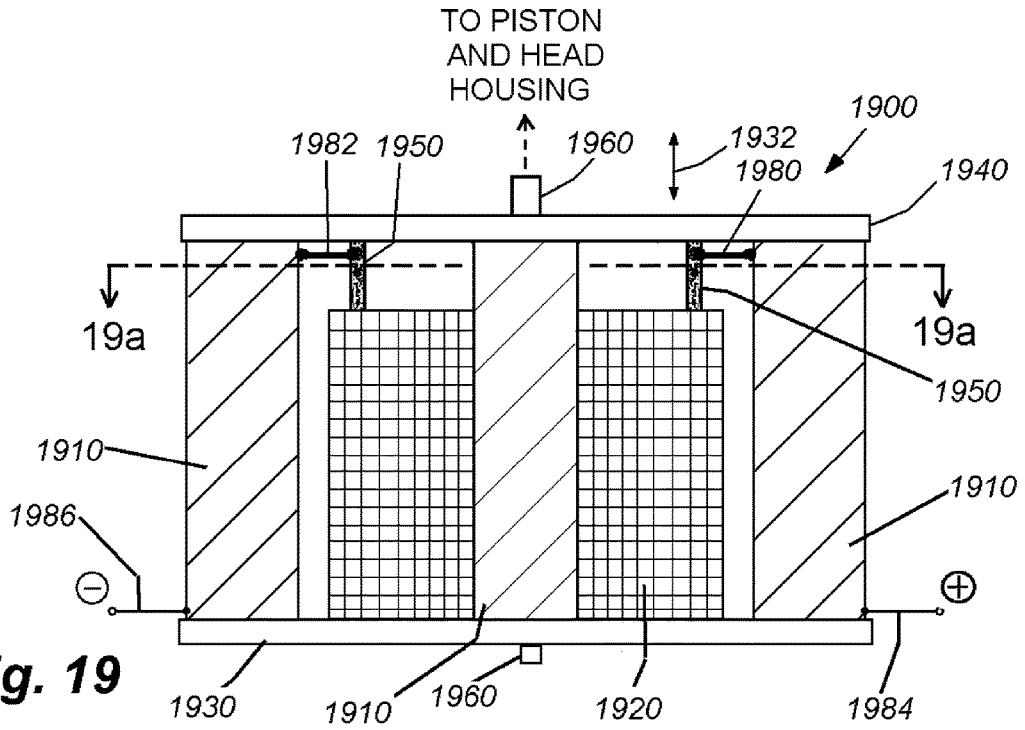
FIG. 19 is an exposed side view of a pump motor or MICE alternator resonant system using multiple springs.
Figure 19A:
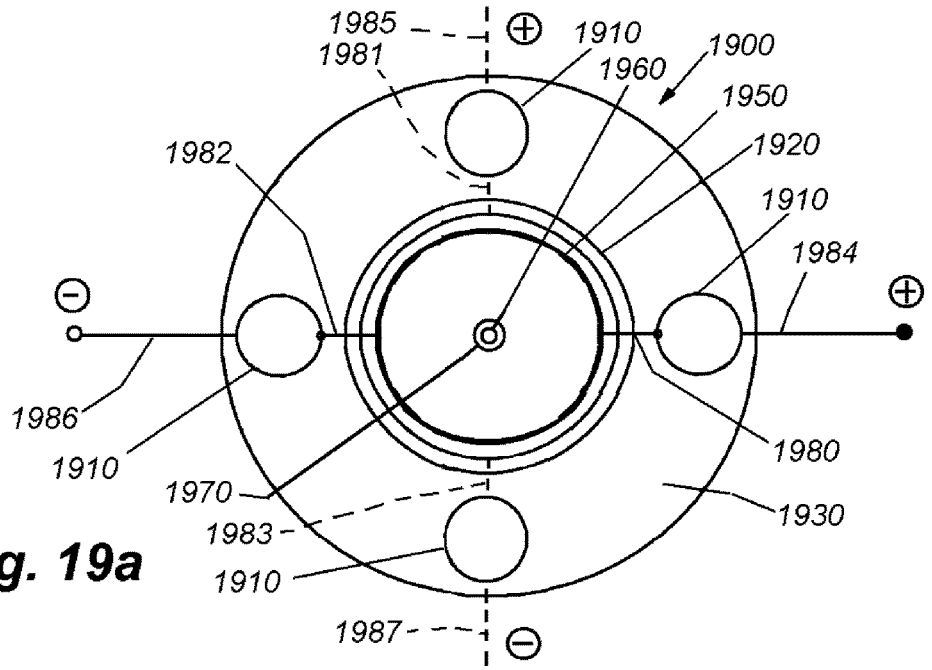
FIG. 19*a* is a top cross section taken along line 19*a*-19*a* of FIG. 19.

With reference to FIGS. 19 and 19*a*, a motor or alternator configuration 1900 using multiple springs in association with a resonant system is provided. This arrangement allows for a compact, low L/D aspect ratio, while avoiding (being free of) a large and heavy single, multi-helix spring. The outer housing of the arrangement has been omitted for clarity. As shown, the motor/alternator configuration 1900 employs multiple, smaller diameter springs 1910 with a multiplicity of single-helix or multiple-helix spring turns. In this embodiment, four springs 1910 are arranged symmetrically around the motor magnet pole assembly 1920. The number and placement of springs is highly variable in further embodiments. The springs can be constructed as machined springs having integral attachment features (such as threaded holed for screws—not shown) at both ends to facilitate attachment to a base 1930 at the bottom and a resonantly moving (double arrow 1932), coil mounting disk 1940 at the top. The coil mounting disk 1940 supports the resonant coil assembly 1950, which is nested coaxially within the magnet assembly 1920. The piston drive and centering rod 1960 is fixedly attached to the coil mounting disk 1940 and (in this embodiment) passes through the arrangement 1900. This rod 1960 is driven by, or drives the coil 1950.

Figure 20:
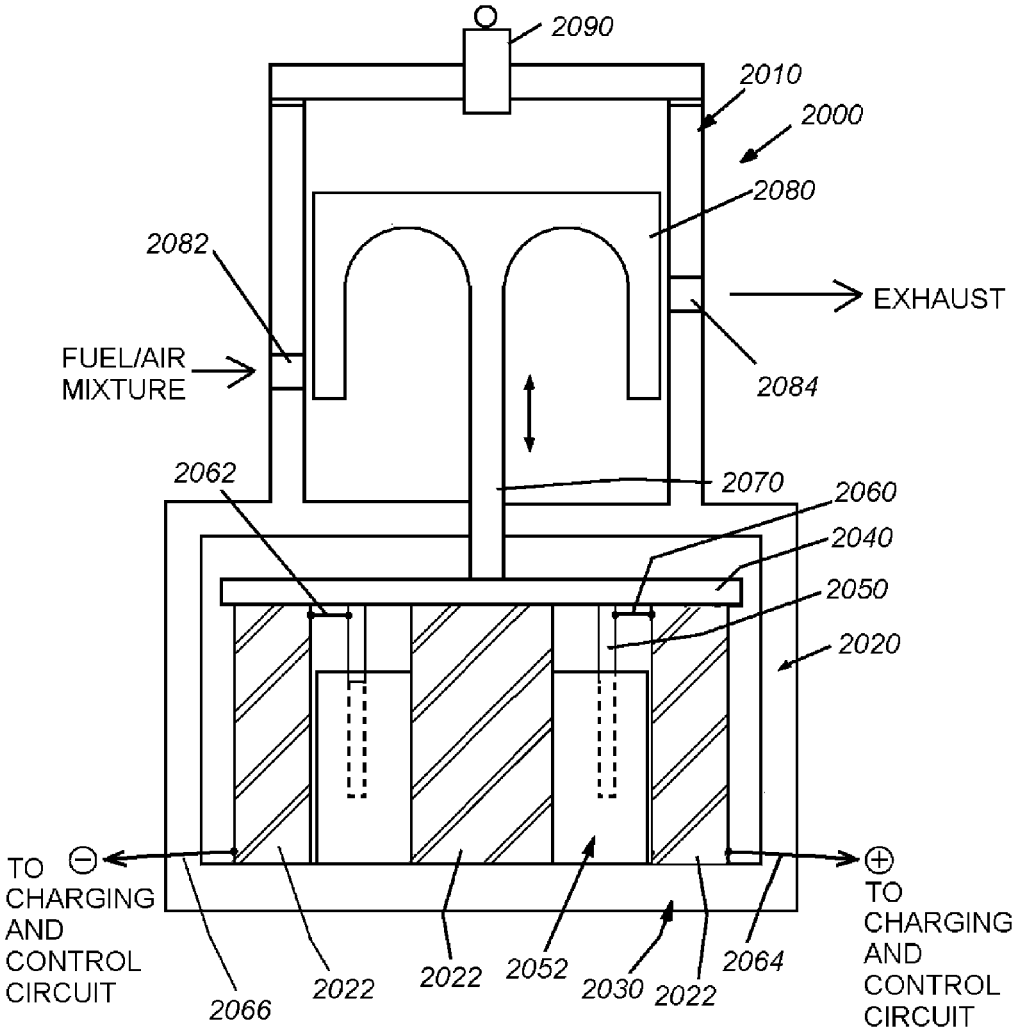
FIG. 20 is an exposed side view of an illustrative MICE with an alternator resonant system using multiple springs, which also serve as electrical leads, according to an illustrative embodiment.

The drive and centering rod 1960 has two primary functions. The first function is to transmit linear force to or from the piston assembly within the pump or engine head assembly. This head assembly is shown, for example in FIG. 18 and in other figures hereinabove (and in FIGS. 20 and 21 below). The second function of the rod 1960 is to center the coil mounting disk 1940, and ensure that it translates in substantially pure (exclusive) linear motion. Linear motion is enhanced by incorporating sleeve bearings (1970 in FIG. 19*a*) in the center of the ends of the motor magnet pole assembly 1920. The sleeve bearings 1970 have an inner diameter that closely conforms to the diameter of the drive rod to allow low friction movement of the drive rod while essentially eliminating any transverse movement or tilt. The pure linear motion ensured by the drive rod 1960 and sleeve bearings 1970 is desirable for allowing the air gap of the magnet/magnet pole assembly to be maintained at a value only slightly larger than the coil width (diameter) to provide high magnetic flux through the coil. Note that, while the coil 1950 and magnet 1920 are each cylindrical, they can define another, nested cross-sectional shape, such as a polygon.

Note also that the springs 1910 in this embodiment, and other embodiments described hereinbelow, employ fixed attachments at both (opposing) ends because the resonant operation of the spring and motor/alternator arrangement 1900 places the springs operate into both compression and extension. Such extension could result in dislodgement of a non-fixed spring from the base 1920, mounting disk 1940, or both. Symmetric placement of the springs ensures that the torque and bending force exerted by each spring on the base 1920 and the mounting disk 1940 are appropriately cancelled, either completely or nearly completely, by symmetry. Note that if single-helix springs are used, it is desirable that the end positions of each spring are symmetric relative to the center of the base 1920 and coil mounting disk 1940 to ensure cancellation of torques and bending forces.

Illustratively, the use of multiple helical springs in an arrangement that is vertically co-located with a linear motor or alternator can provide a compact resonant spring and motor/alternator system for driving the piston in a free piston pump or driving the coil in a MICE. The depicted configuration 1900 generally defines an L/D ratio of the motor/alternator-spring components that can be less than 1 while the multiple springs have a total weight that is a small fraction of the weight of a single multiple helix spring employed in the pump/MICE configuration 1900 shown in FIG. 18. An actual comparison of the illustrative configuration 1900 relative to a single-spring arrangement (FIG. 18) provides desirable advantages. Notably, the weight of a single spring meeting the requirement that the inner diameter be large enough for the motor to be embedded within the spring is approximately 81 grams. Conversely, the weight of four smaller diameter springs in the arrangement of FIGS. 19 and 19*a* that provides the same resonant operating frequency is 21.6 grams. Additionally, a single spring as defined in the arrangement of FIG. 18 comprises a double-helix spring having 0.5 turns for each helical coil. Those of skill would recognize that this is a significantly low number of turns, and significantly deviates from a standard spring design. Conversely, the small diameter springs (1910) of the arrangement of FIGS. 19 and 19*a* are illustratively constructed with approximately 5.5 turns, and conform to conventional design criteria. Thus, the use of multiple small springs instead of a single large-diameter spring significantly reduces the configuration's weight, and allows conventional springs to be employed.

The use of multiple springs 1910 in the resonant spring/motor system allows the use of a new approach for obtaining a stationary lead from a moving coil. Likewise, since the springs are generally smaller the above-described approach of adhering the leads to the surface of one or more helices of the spring can prove more challenging. The use of multiple helical springs 1910 in the spring/motor resonant system enables a more-straightforward and less labor-intensive approach to providing stationary electrical leads between the moving coil and the housing. With reference to FIGS. 19 and 19*a* two moving electrical leads 1980 and 1982 are directed from the top of the coil assembly 1950 (including a standoff and coil wrap) along the mounting disk 1940 to electrical connections at the top of each of a pair of springs (1910). Stationary leads 1984 and 1986 are provided from the bottom of the springs (1910) at the base 1930. The two springs are electrically conductive, using an appropriate conductive metal, such as steel alloy. Where less conductive materials are employed (e.g. titanium), a coating or plating of a more-conductive material can be applied to the surface of the spring—such as copper. Leads are then connected to the coating layer. To isolate the circuit of each spring (and its leads), the mounting disk 1940 and base 1930 can be fabricated from non-conducting material or can have non-conducting inserts at the spring mounting locations. Additionally, the springs can be over-coated with a thin insulating conformal coating such as parylene to prevent accidental shorting of the electrical leads.

While FIGS. 19 and 19*a* show illustrative electrical connections to two springs, it is contemplated that it can be advantageous in certain arrangements for each coil electrical lead to connect to more than one spring. Thus, secondary leads 1981, 1983, and 1985, 1987 (shown in phantom in FIG. 19*a*) can interconnect the coil assembly 1950 to the other two springs (1910) and the outer housing, respectively. Some benefits of employing two or more springs as parallel coil electrical leads is (for example) simplicity and reduced cost relative to the approach of attaching coil wire leads to the spring coils. Additional benefits are increased ruggedness of the springs as electrical leads compared with fine gauge magnet wire, and reduced parasitic electrical resistance since the cross sectional area of the springs is much greater than that of the fine gauge magnet wire.

Figure 19B:
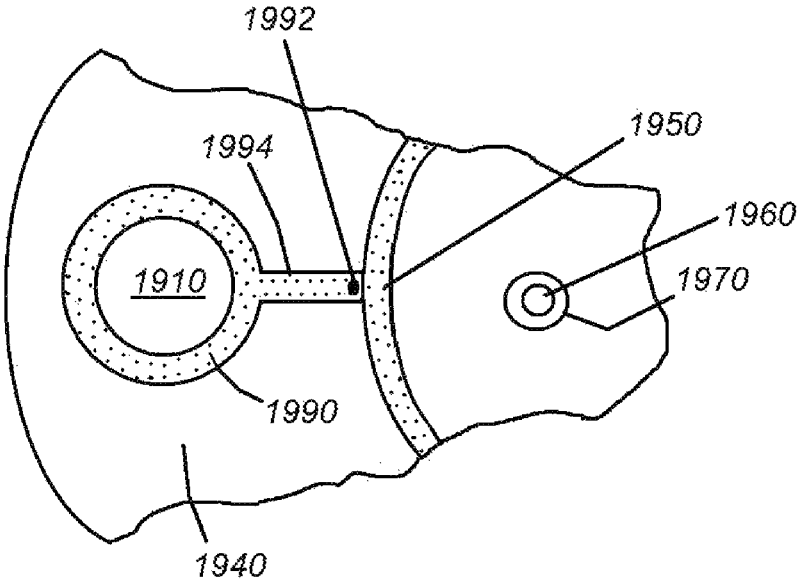
FIG. 19*b* is a fragmentary bottom view of the moving coil mounting disk showing a connection arrangement according to a further embodiment.

An alternative to the use of wire leads (i.e. 1980, 1982) on the coil mounting disk 1940 and (optionally) on the base 1930 is shown in FIG. 19*b*, and employs a solid (e.g. copper sheet) or coated (e.g. conductive ink) conductive pad 1990 that adheres directly to bottom surface of the disk 1940. This pad 1990 underlies the spring 1910 and extends (via branch 1994) on the surface to a location in electrical contact with a wire end 1992 of the coil assembly 1950. This arrangement avoids the use of connecting wires and provides a quicker assembly process. Thus, the term "lead" shall be taken herein to include both pad-style and wire-style interconnections.

While the above description is applicable to both a free-piston pump arrangement and a two-stroke MICE arrangement, by way of further illustration in understanding the concepts herein reference is made to the exposed side view of a MICE arrangement 2000 having a piston head housing 2010 overlying a larger diameter alternator housing 2020 having an arrangement of multiple (e.g. four) symmetrically placed springs 2022 that reside on a base 2030 and are compressed/expanded by the motion of a coil mounting disk 2040. The coil mounting disk carries an alternator coil assembly 2050 including an alternator coil standoff. The coil assembly 2050 is nested within an alternator magnet pole assembly 2052, and as shown, the springs 2022 reside outside both the magnet 2052 and coil assembly 2050. In accordance with the embodiments above, two or more of the springs can act as electrical connections for the moving coil via leads 2060, 2062, 2064 and 2066. The leads 2064 and 2066 interconnect the coil to a charging and control circuit that modulates the drive of the unit (as described further in the above-incorporated U.S. Patents) and routes useable power to a storage battery system. The alternator coil is driven by a piston and centering rod 2070 in a manner described above. This rod 2070 is connected to the piston 2080, which is adapted to compress a drawn-in fuel air mixture from an inlet port 2082 on an upstroke and combust compressed fuel/air, which powers a downstroke. The exhaust gas is expelled via an exhaust port 2084. Control of fuel intake can be provided by an appropriate fuel system including a carburetor (or fuel injector), fuel pump and other associated components as described in the above-incorporated U.S. Patents. It should be clear to those of skill that a wide variety of fuel system components can be employed to deliver a metered quantity of fuel and air to the inlet port 2082. A glow plug 2090 located at the top of the piston head casing/housing 2010 can assist combustion during, for example cold start-up.

Figure 21:
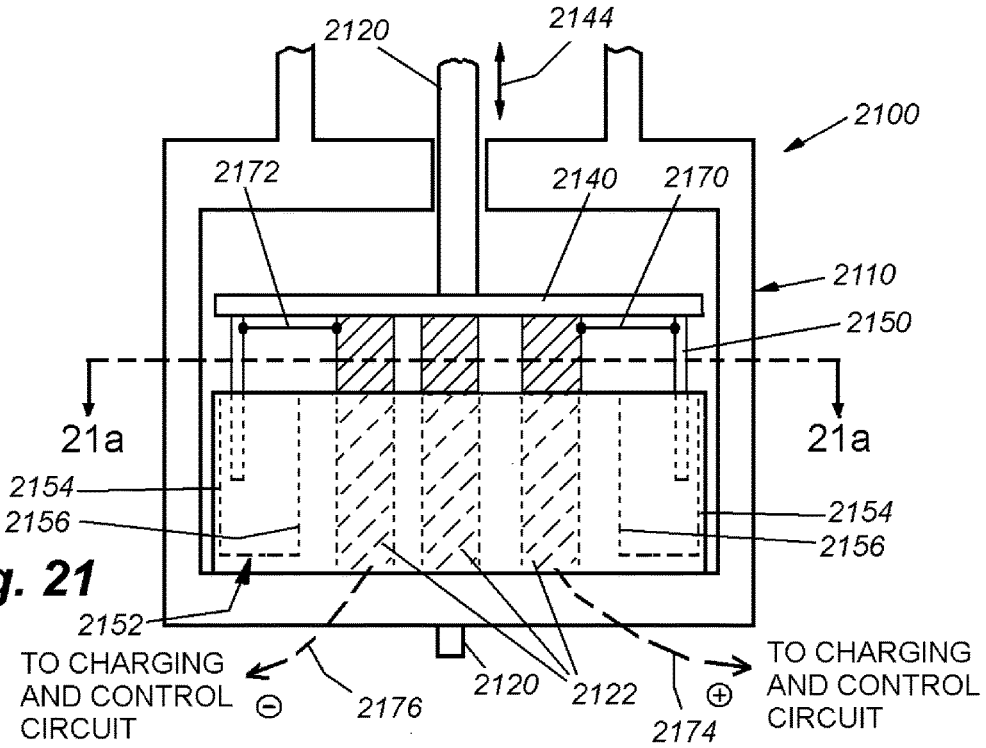
FIG. 21 is an exposed side view of the alternator assembly of a MICE according to an alternate embodiment in which multiple springs are located within the inner bore of the alternator, and also serve as electrical leads.
Figure 21A:
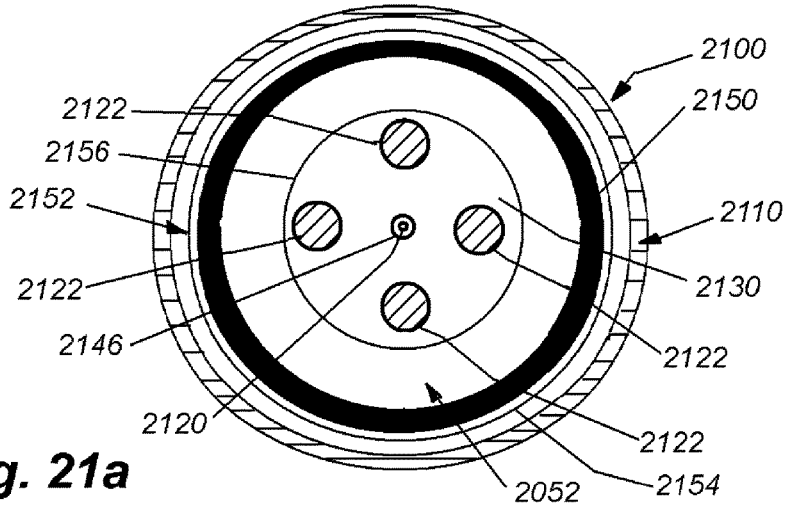
FIG. 21*a* is a top cross section taken along line 21*a*-21*a* of FIG. 21 showing the spring and alternator coil arrangement.

FIGS. 21 and 21*a* illustratively show an alternate arrangement of a moving alternator (or pump motor) coil for a resonant system 2100 with multiple springs. In particular this arrangement can be implemented as a two-stroke MICE, or can be implemented as the above-described pump. Thus either type of piston and head casing/housing arrangement can overlie the alternator/motor housing 2110, and the details of such housing are omitted. As described above, the piston is interconnected by an appropriate drive and centering rod 2120 to the coil mounting disk 2140. Four symmetrically placed springs 2122 are fixed to the disk and also to an opposing base 2130. The springs are compressed and expanded by action (double arrow 2144 of the disk 2140 in association with the drive rod 2120. In this embodiment, the magnet pole assembly is the external-most member of the alternator with the coil nested between the outer magnet pole 2154 and inner magnet pole 2156. All springs 2122 notably reside within the inner magnet pole 2156. An advantage of this arrangement is that it minimizes the amount of tilt that can occur if the springs are not substantially (or perfectly) balanced and/or symmetrical. Note that one or more sleeve bearings 2146 can be used to guide the rod 2120, and maintain the coil assembly 2150 in proper orientation with respect to the magnet pole assembly 2052. This placement serves to constrain the rod 2120 to allow for perfectly linear motion, although it can also introduce additional frictional losses to the system.

In any of the multiple spring embodiments described or contemplated herein, it is expressly contemplated that an arrangement of three springs can be employed, such springs being symmetrically arranged as points of an equilateral triangle. As shown the four-spring embodiment comprises a square arrangement. Likewise five or more symmetrically arranged springs can be arranged as points of an associated regular polygon—i.e. a regular pentagon (five springs) a regular hexagon (six springs), etc. Other symmetrical arrangements are also contemplated.

Also, in a manner described above, the springs 2122 can act as electrical connections between leads 2170 and 2172 to the coil assembly 2150 and leads 2174 and 2176 to an external circuit.

Note that it is expressly contemplated that the coil and magnet assemblies with multiple springs as described herein can be operatively connected via a piston rod with a piston (or plurality of pistons) that interacts with multiple piston chambers as shown, for example, in FIGS. 5*a* and 5*b*. Likewise, it is contemplated that symmetrically placed springs can be located both internal of the coil and magnet assemblies and external of the coil and magnet assemblies.

It should be clear that the various embodiments of a free piston pump and MICE described herein address a variety of technical challenges in designing and implementing such a system. Likewise, the various improvements provided to the motor/alternator assembly of the pump/MICE reduce cost and complexity in assembly, lower weight and the L/D ratio of the unit, and increase long-term reliability of the electrical system.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the arrangement of inlets and outlets is highly variable. The mounting for the pump, while not shown, can be any acceptable structure that engages the pump housing and prevents unwanted motion with respect to the surroundings. Appropriate dampening—for example with respect to the above-described spring arrangement that interconnects the housing to the base—can be provided in various embodiments. Additionally a variety of spring arrangements and shapes are expressly contemplated including double-spring systems such as those described in the above-incorporated U.S. Patents. In addition while coil mounting disks and bases are shown as circular shapes the terms "base" and "disk" should be taken broadly to include non-circular shapes and circular shapes with interruptions as appropriate. Additionally while the illustrative embodiments generally show a moving coil and a stationary magnet assembly, these terms can be used interchangeably and a moving magnet assembly with stationary coil assembly can be provided in alternate embodiments. Moreover, the various pumps described herein can be adapted for use with any form of sufficiently transportable fluid including liquids (water, for example), gasses (air, for example) and various gas-liquid and liquid-solid mixtures. The term "fluid" should thus be taken broadly to include such compounds. Also, as used herein, various directional and orientation terms such as "vertical", "horizontal", "up", "down", "bottom", "top", "side", "front", "rear", "left", "right", and the like, are used only as relative conventions and not as absolute orientations with respect to a fixed coordinate system, such as gravity. Accordingly, this description is meant to be taken only by way of example, and not to otherwise limit the scope of this invention.

What is claimed is:

1. A coil and magnet assembly that is operatively interconnected with an oscillating free piston that moves along an axis comprising:

a coil mounting disk operatively connected to a coil assembly;

a magnet assembly mounted on a magnet base, the magnet assembly being coaxial with respect to the coil assembly, wherein the coil assembly and the magnet assembly are in oscillating motion with respect to each other in conjunction with oscillating motion of the free piston; and a spring assembly comprising at least three resonant springs, having centers spaced apart from the axis and symmetrically positioned in at least three positions about the axis, that extend between, and are fixedly attached to, the magnet base and the coil mounting disk so as to compress and expand in resonance with the oscillating motion along the axis, the resonant springs storing energy from the piston when the piston moves in a first direction, and providing energy to the piston when the piston moves in a second direction, wherein the coil assembly, the magnet assembly, and the resonant springs are concentric and axially aligned, and wherein the coil assembly, the magnet assembly, and the resonant springs are between the magnet base and the coil mounting disk.

2. The coil assembly and magnet assembly as set forth in claim 1 wherein at least some of the springs are conductive and electrically connect the mounting disk to the magnet base.

3. The coil and magnet assembly as set forth in claim 2 wherein the coil is interconnected by a lead with a respective first end of each spring of at least some of the springs and a stationary position on a housing is interconnected by a lead with an opposing, respective second end of each spring.

4. The coil and magnet assembly as set forth in claim 3 wherein each of the mounting disk and the magnet base are insulating so as to electrically isolate interconnection with each of the first end and the second end of each spring.

5. The coil and magnet assembly as set forth in claim 1 wherein each spring of the plurality of springs is located external of the coil assembly and the magnet assembly.

6. The coil and magnet assembly as set forth in claim 1 wherein each of the springs is located internal to the coil assembly and the magnet assembly.

7. The coil and magnet assembly as set forth in claim 1 wherein the free piston includes a rod interconnecting a piston head to the mounting disk.

8. The coil and magnet assembly as set forth in claim 7 wherein the base includes a sleeve bearing that receives the rod so as to generate exclusively linear motion along the axis.

9. The coil and magnet assembly as set forth in claim 1 wherein the piston is constructed and arranged to move in a cylinder casing having a fuel intake port and exhaust port so as to provide a two-stroke internal combustion engine.

10. The coil assembly and magnet assembly as set forth in claim 9 wherein the coil is operatively connected with an electrical charging circuit and an engine control circuit that controls motion of the piston based upon control of the coil assembly.

11. The coil assembly and magnet assembly as set forth in claim 10 wherein the coil is interconnected by a lead with a respective first end of each spring of at least some of the springs and a stationary position on a housing is interconnected by a lead with an opposing, respective second end of each spring.

12. The coil and magnet assembly as set forth in claim 1 wherein the piston is constructed and arranged to move in a cylinder casing having a fluid intake port and fluid outlet port so as to provide a fluid pump.

13. The coil assembly and magnet assembly as set forth in claim 12 wherein the coil is operatively connected with an electrical motor-driving circuit and a motor control circuit that controls motion of the piston based upon control of the coil assembly.

14. The coil assembly and magnet assembly as set forth in claim 13 wherein the coil is interconnected by a lead with a respective first end of each spring of at least some of the springs and a stationary position on a housing is interconnected by a lead with an opposing, respective second end of each spring.

15. The coil and magnet assembly as set forth in claim 12 wherein the piston moves in a pump head that defines a dual chamber pump head.

16. The coil and magnet assembly as set forth in claim 12 wherein a pump head defines at least a dual chamber pump head and including a central fluid inlet.

17. The coil and magnet assembly as set forth in claim 13 wherein the motor control circuit that controls motion of the piston based upon control of the coil assembly further controls a cycle frequency of the piston, wherein the cycle frequency is set to a first predetermined frequency determined by a resonant frequency of a mass of the fluid pump, the multiple resonant springs, and a pump chamber pressure.

18. The coil and magnet assembly as set forth in claim 1, wherein the resonant springs are constructed with approximately 5.5 turns per helical coil.

19. A coil and magnet assembly that is operatively interconnected with an oscillating free piston that moves along an axis comprising:

a coil mounting disk operatively connected to a coil assembly;

a magnet assembly mounted on a magnet base, the magnet assembly being coaxial with respect to the coil assembly, wherein the coil assembly and the magnet assembly are in oscillating motion with respect to each other in conjunction with oscillating motion of the free piston;

a spring assembly comprising at least three resonant springs, having centers spaced apart from the axis and symmetrically positioned in at least three positions about the axis, that extend between the magnet base and the coil mounting disk so as to move in resonance with the oscillating motion along the axis, the resonant springs storing energy from the piston when the piston moves in a first direction, and providing energy to the piston when the piston moves in a second direction, wherein the coil assembly, the magnet assembly, and the resonant springs are concentric and axially aligned, and wherein the coil assembly, the magnet assembly, and the resonant springs are between the magnet base and the coil mounting disk; and wherein at least some of the springs are conductive and electrically connect the mounting disk to the magnet base.

20. The coil and magnet assembly as set forth in claim 19 wherein the piston is constructed and arranged to move in one of either (a) a cylinder casing having a fuel intake port and exhaust port so as to provide a two-stroke internal combustion engine, or (b) a cylinder casing having a fluid intake port and fluid outlet port so as to provide a fluid pump.

21. A coil and magnet assembly that is operatively interconnected with an oscillating free piston that moves along an axis comprising:

a coil mounting disk operatively connected to a coil assembly;

a magnet assembly mounted on a magnet base, the magnet assembly being coaxial with respect to the coil assembly, wherein the coil assembly and the magnet assembly are in oscillating motion with respect to each other in conjunction with oscillating motion of the free piston; and a spring assembly comprising at least three resonant springs, having centers spaced apart from the axis and symmetrically positioned in at least three positions about the axis, that extend between, and are fixedly attached to, the magnet base and the coil mounting disk so as to compress and expand in resonance with the oscillating motion along the axis, the resonant springs storing energy from the piston when the piston moves in a first direction away from the center position, and providing energy to the piston when the piston moves in a second direction toward the center position, wherein the coil assembly, the magnet assembly, and the resonant springs are concentric and axially aligned, and wherein the coil assembly, the magnet assembly, and the resonant springs are between the magnet base and the coil mounting disk.

* * * * *